US010028551B2

(12) United States Patent
Cavaliere

(10) Patent No.: US 10,028,551 B2
(45) Date of Patent: Jul. 24, 2018

(54) INTERCHANGEABLE CHASSIS FOR CLEATED FOOTWEAR

(71) Applicant: NIKE, Inc., Beaverton, OR (US)

(72) Inventor: Sergio Cavaliere, Venice (IT)

(73) Assignee: NIKE, Inc., Beaverton, OR (US)

( * ) Notice: Subject to any disclaimer, the term of this patent is extended or adjusted under 35 U.S.C. 154(b) by 524 days.

(21) Appl. No.: 14/260,707

(22) Filed: Apr. 24, 2014

(65) Prior Publication Data

US 2015/0305447 A1 Oct. 29, 2015

(51) Int. Cl.

| | |
|---|---|
| ***A43C 15/16*** | (2006.01) |
| ***A43B 5/00*** | (2006.01) |
| ***A43B 5/02*** | (2006.01) |
| ***A43B 13/12*** | (2006.01) |
| ***A43B 13/14*** | (2006.01) |
| ***A43B 13/26*** | (2006.01) |

(52) U.S. Cl.

CPC ..... *A43C 15/161* (2013.01); *A43B 5/001* (2013.01); *A43B 5/02* (2013.01); *A43B 13/122* (2013.01); *A43B 13/14* (2013.01); *A43B 13/26* (2013.01)

(58) Field of Classification Search

CPC ..... A43B 5/001; A43B 5/02; A43B 13/122; A43B 13/14; A43B 13/26; A43C 15/14; A43C 15/16; A43C 15/161

USPC .... 36/66, 62, 67 A, 67 D, 59 R, 25 R, 67 R, 36/134, 126, 127, 128

See application file for complete search history.

(56) References Cited

U.S. PATENT DOCUMENTS

| | | | | |
|---|---|---|---|---|
| 1,594,056 A * | 7/1926 | Floyd | A43C 15/162 | 36/128 |
| 3,040,449 A * | 6/1962 | Phillips | A43C 15/161 | 36/127 |
| 3,204,347 A * | 9/1965 | Snow | A43B 5/06 | 36/107 |

(Continued)

FOREIGN PATENT DOCUMENTS

| | | |
|---|---|---|
| EP | 1935268 | 6/2008 |
| GB | 2477285 | 8/2011 |

OTHER PUBLICATIONS

International Search Report and Written Opinion dated Aug. 18, 2015 in PCT/US2015/025117.

(Continued)

*Primary Examiner* — Sharon M Prange
*Assistant Examiner* — James Heracklis
(74) *Attorney, Agent, or Firm* — Honigman Miller Schwartz and Cohn LLP; Matthew H. Szalach; Jonathan P. O'Brien

(57) ABSTRACT

An article of footwear including cleat sets and/or cleat members can include provisions for maximizing traction between a chassis and multiple types of ground surfaces. In some embodiments, a chassis can include cleat sets and/or cleat members disposed in different locations to achieve maximum traction on multiple types of surfaces. In other embodiments, a chassis can include distinct types of cleat sets and/or cleat members that each maximize traction for a distinct type of surface. Each chassis includes a distinct type of cleat configuration. Different cleat configurations may be used to provide varying degrees of traction. In some embodiments, the chassis can include varying levels of flexibility, to provide user with options to customize the stiffness and support of the article of footwear.

16 Claims, 19 Drawing Sheets

(56) References Cited

U.S. PATENT DOCUMENTS 3,328,901 A * 7/1967 Strickland ..... A43C 15/161 36/127
3,442,033 A * 5/1969 Hilburn, Jr. ..... A43B 5/00 36/114
3,526,976 A * 9/1970 Jacobs ..... A43B 5/1633 280/11.3
4,392,312 A * 7/1983 Crowley ..... A43B 13/26 36/126
4,454,662 A * 6/1984 Stubblefield ..... A43B 5/00 36/102
4,546,559 A * 10/1985 Dassler ..... A43B 5/06 36/114
4,590,693 A * 5/1986 Kawashima ..... A43C 15/162 36/126
4,782,604 A * 11/1988 Wen-Shown ..... A43B 5/001 36/127
4,858,343 A * 8/1989 Flemming ..... A43B 13/26 36/128
4,875,300 A * 10/1989 Kazz ..... A43B 13/26 36/114
5,410,821 A * 5/1995 Hilgendorf ..... A43B 1/0081 36/100
5,461,801 A * 10/1995 Anderton ..... A43B 3/0052 24/713.4
5,473,827 A * 12/1995 Barre ..... A43B 5/02 36/128
5,628,129 A * 5/1997 Kilgore ..... A43C 13/04 36/126
5,661,915 A * 9/1997 Smith ..... A43B 3/24 36/101
5,873,184 A * 2/1999 Ihlenburg ..... A43B 13/26 36/126
5,932,336 A 8/1999 Allen et al.
5,979,083 A * 11/1999 Robinson ..... A43B 1/0072 36/102
6,016,613 A * 1/2000 Campbell ..... A43B 5/001 36/127
6,256,907 B1 * 7/2001 Jordan ..... A43C 15/14 36/134
6,289,611 B1 * 9/2001 Patterson ..... A43B 5/001 36/127
6,345,454 B1 * 2/2002 Cotton ..... A43B 3/24 36/101
6,442,869 B2 * 9/2002 Coomes ..... A43B 3/0078 36/100
6,442,872 B1 * 9/2002 Liao ..... A43C 15/161 36/114
6,754,984 B2 6/2004 Schaudt et al.
6,793,996 B1 * 9/2004 Umezawa ..... A43B 5/001 36/126
6,813,847 B2 * 11/2004 Workman ..... A43B 3/18 36/100
6,954,998 B1 * 10/2005 Lussier ..... A43B 5/02 36/107
6,973,745 B2 * 12/2005 Mills ..... A43B 3/0068 36/113
7,181,868 B2 * 2/2007 Auger ..... A43B 5/02 36/103
7,246,453 B2 * 7/2007 Kim ..... A43B 5/00 36/100
7,428,790 B2 * 9/2008 Pellerin ..... A43B 5/00 36/126
7,536,810 B2 * 5/2009 Jau, Jr. ..... A43B 5/14 36/131
7,594,666 B2 * 9/2009 Wegener ..... A63C 17/06 280/11.12
7,650,707 B2 * 1/2010 Campbell ..... A43B 3/0057 36/102
7,654,013 B2 * 2/2010 Savoie ..... A43B 13/141 36/127
7,654,014 B1 * 2/2010 Moore ..... A43B 3/0042 36/127
7,730,636 B2 * 6/2010 Auger ..... A43B 5/02 36/100
7,739,809 B2 * 6/2010 Keating ..... A43B 3/24 36/15
7,866,064 B2 1/2011 Gerber
D688,036 S * 8/2013 Dekovic ..... D2/946
D688,037 S * 8/2013 Dekovic ..... D2/946
8,516,720 B2 8/2013 Gerber
8,616,892 B2 * 12/2013 Morag ..... A43B 5/02 434/251
8,677,657 B2 * 3/2014 Bacon ..... A43B 5/001 36/103
8,713,819 B2 * 5/2014 Auger ..... A43B 5/02 36/102
8,720,086 B2 * 5/2014 Auger ..... A43C 15/162 36/134
8,869,435 B2 * 10/2014 Hatfield ..... A43B 5/001 36/102
8,925,219 B2 * 1/2015 Napurano ..... A43C 13/04 36/134
8,966,787 B2 * 3/2015 Auger ..... A43B 5/02 36/128
8,973,290 B2 * 3/2015 Howley ..... A43B 13/14 36/107
9,032,645 B2 * 5/2015 Stauffer ..... A43C 15/00 36/67 R
9,044,064 B2 * 6/2015 Baucom ..... A43B 13/122
D735,982 S * 8/2015 Pauk ..... D2/951
9,314,065 B2 * 4/2016 Auger ..... A43B 5/02
9,364,043 B2 * 6/2016 Cavaliere ..... A43B 13/14
9,609,915 B2 * 4/2017 Rushbrook ..... A43B 13/22
9,675,133 B2 * 6/2017 Howley ..... A43B 13/122
9,700,103 B2 * 7/2017 Hatfield ..... A43C 15/02
2001/0032351 A1 * 10/2001 Nakayama ..... A42B 3/064 2/412
2002/0100190 A1 * 8/2002 Pellerin ..... A43B 5/00 36/126
2002/0174571 A1 * 11/2002 Briant ..... A43B 13/26 36/134
2002/0178619 A1 * 12/2002 Schaudt ..... A43B 5/02 36/128
2003/0230007 A1 * 12/2003 Walton ..... A43B 3/128 36/15
2004/0000071 A1 * 1/2004 Auger ..... A43B 5/02 36/59 R
2004/0000075 A1 * 1/2004 Auger ..... A43B 5/02 36/128
2005/0016029 A1 * 1/2005 Auger ..... A43B 1/0072 36/134
2005/0198868 A1 * 9/2005 Scholz ..... A43B 3/24 36/67 D
2006/0042119 A1 * 3/2006 Workman ..... A43B 5/08 36/15
2006/0130361 A1 * 6/2006 Robinson, Jr. ..... A43B 1/0072 36/25 R
2006/0242863 A1 * 11/2006 Patmore ..... A43B 13/26 36/127
2007/0227039 A1 * 10/2007 Chaney ..... A43B 5/08 36/15
2008/0196274 A1 * 8/2008 Gerber ..... A43B 13/36 36/100
2008/0222920 A1 * 9/2008 Rovida ..... A43B 5/18 36/100
2009/0013561 A1 * 1/2009 Robinson, Jr. ..... A43B 5/001 36/127
2009/0100716 A1 * 4/2009 Gerber ..... A43B 5/02 36/114
2009/0100718 A1 * 4/2009 Gerber ..... A43B 13/145 36/128
2009/0249648 A1 * 10/2009 Brown ..... A43B 5/001 36/91
2009/0293315 A1 * 12/2009 Auger ..... A43B 5/02 36/114
2010/0101005 A1 * 4/2010 Cripton ..... A42B 3/0473 2/411

(56) References Cited

U.S. PATENT DOCUMENTS

2010/0122473 A1* 5/2010 Santos ..... A43B 13/36 36/100
2010/0192421 A1* 8/2010 Kerns ..... A43B 5/14 36/3 B
2010/0229427 A1* 9/2010 Campbell ..... A43B 7/142 36/134
2011/0047830 A1* 3/2011 Francello ..... A43B 13/203 36/134
2011/0088287 A1* 4/2011 Auger ..... A43B 5/02 36/107
2011/0126426 A1* 6/2011 Mark ..... A43C 15/14 36/61
2011/0167676 A1* 7/2011 Benz ..... A43C 15/162 36/134
2011/0197478 A1* 8/2011 Baker ..... A43B 13/12 36/59 R
2011/0289801 A1* 12/2011 Amos ..... A43B 13/141 36/134
2012/0210608 A1* 8/2012 Baker ..... A43C 15/14 36/134
2012/0279091 A1* 11/2012 Baucom ..... A43B 3/0042 36/67 A
2013/0031810 A1* 2/2013 Auger ..... A43C 15/14 36/25 R
2013/0047465 A1* 2/2013 Auger ..... A43B 13/223 36/66
2013/0067765 A1* 3/2013 Auger ..... A43B 5/02 36/31
2013/0067774 A1* 3/2013 Auger ..... A43B 5/02 36/103
2013/0067776 A1* 3/2013 Auger ..... A43B 5/02 36/25 R
2013/0333247 A1* 12/2013 Grott ..... A43B 5/001 36/127
2013/0333248 A1* 12/2013 Auger ..... A43B 3/0052 36/134
2013/0340295 A1* 12/2013 Adami ..... A43B 5/02 36/25 R
2014/0041257 A1* 2/2014 Robinson ..... A43B 3/244 36/100
2014/0259786 A1* 9/2014 Heard ..... A43B 13/14 36/103
2014/0366402 A1* 12/2014 Cavaliere ..... A43B 13/14 36/25 R
2015/0282557 A1* 10/2015 Kirk ..... A43B 13/141 36/31
2015/0305447 A1* 10/2015 Cavaliere ..... A43C 15/161 36/66
2016/0073733 A1* 3/2016 Auger ..... A43B 5/02 36/59 R
2016/0120265 A1* 5/2016 Cavaliere ..... A43C 15/161 36/134

OTHER PUBLICATIONS

Invitation to Pay Additional Fees and, Where Applicable, Protest Fee and Partial Search Report dated Jun. 12, 2015 in PCT Application No. PCT/US2015/025117.

State Intellectual Property Office (PRC), Office Action for CN Application No. 201580021094.3, dated Oct. 31, 2017.

* cited by examiner

INTERCHANGEABLE CHASSIS FOR CLEATED FOOTWEAR

BACKGROUND

The present embodiments relate generally to footwear, and in particular the present disclosure relates to footwear with cleats.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. In addition, the upper may include a tongue that extends under the lacing system to enhance adjustability and comfort of the footwear, and the upper may incorporate a heel counter.

SUMMARY

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

In one aspect, an article of footwear includes a forefoot region, a set of removable cleats, one or more cleat receptacles for receiving removable cleats, and at least one chassis. The chassis includes two members that are connected by two cross-members. The chassis also includes a mounting portion to permit attachment to the article of footwear. The mounting portion includes a one or more through-holes, and the number of through-holes corresponds to the number of cleat receptacles. Each through-hole and each cleat receptacle are configured to receive one removable cleat. There is also at least one portion of the underside of the article of footwear in the forefoot region exposed when it is attached to the chassis.

In another aspect, a kit of parts for an article of footwear includes a footwear pair, a set of chassis and at least one set of removable cleats. Each article of footwear in the pair includes a plurality of cleat receptacles for receiving removable cleats. The chassis set includes one or more pairs of different candidate chassis. Each candidate chassis includes two members, and the two members are connected by two cross-members. In addition, each candidate chassis includes a mounting portion to permit attachment to the article of footwear. The mounting portion includes one or more through-holes, so that the number of through-holes corresponds to the number of cleat receptacles. The diameter of each through-hole is also greater than the diameter of each cleat receptacle. A flange is disposed around each through-hole. Each set of removable cleats comprise a one or more removable cleats, and each removable cleat includes a fastener portion. In addition, a segment of the fastening portion is disposed within a cylindrical void within the flange.

In another aspect, a chassis for an article of footwear includes a forefoot region and a heel region, two members, and two cross-members. The two members each extend from the forefoot region to the heel region and comprise a medial member and a lateral member. The medial member is disposed along the medial side of the chassis and the lateral member is disposed along the lateral side of the chassis. The medial member comprises a medial rearward portion and a medial forward portion, and the medial rearward portion and medial forward portion form a continuous piece. The lateral member comprises a lateral rearward portion and a lateral forward portion, so that the lateral rearward portion and lateral forward portion form a continuous piece. The lateral forward portion and the medial forward portion are each disposed in the forefoot region. The medial forward portion extends from the medial rearward portion in a forward direction. The lateral forward portion also extends from the lateral rearward portion in a forward direction. The lateral member and the medial member are connected by the two cross-members, the two cross-members comprising a first cross-member and a second cross-member. The first cross-member connects the medial rearward portion with the lateral rearward portion along their forward ends. The second cross-member connecting the medial rearward portion with the lateral rearward portion along their rearward ends. The first cross-member and the second cross-member are each generally disposed across the width of the chassis. Additionally, there is at least one through-hole disposed along the lateral member and at least one through-hole disposed along the medial member.

In another aspect, a method of assembling an article of footwear includes selecting from a group of chassis candidates. In this method each chassis candidate corresponds to the same side of a foot. In addition, each chassis has a series of through-holes. Each chassis also includes two members that are joined by two cross-members. There is a forward portion and a rearward portion on each member. The forward portion comprises a narrow region like a bridge that extends outward toward the forward end, and concludes in a larger circular region. The circular region includes a through-hole. The method also includes associating the chassis that is selected with the article of footwear, selecting a removable cleat set from a group of removable cleat sets, and attaching the chassis to the article of footwear using at least one of the removable cleats. The article of footwear includes one or more cleat receptacles for receiving the removable cleats, and the number of through-holes corresponds to the number of cleat receptacles. The method thereby attaches the selected chassis to the article of footwear using the selected removable cleat set.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
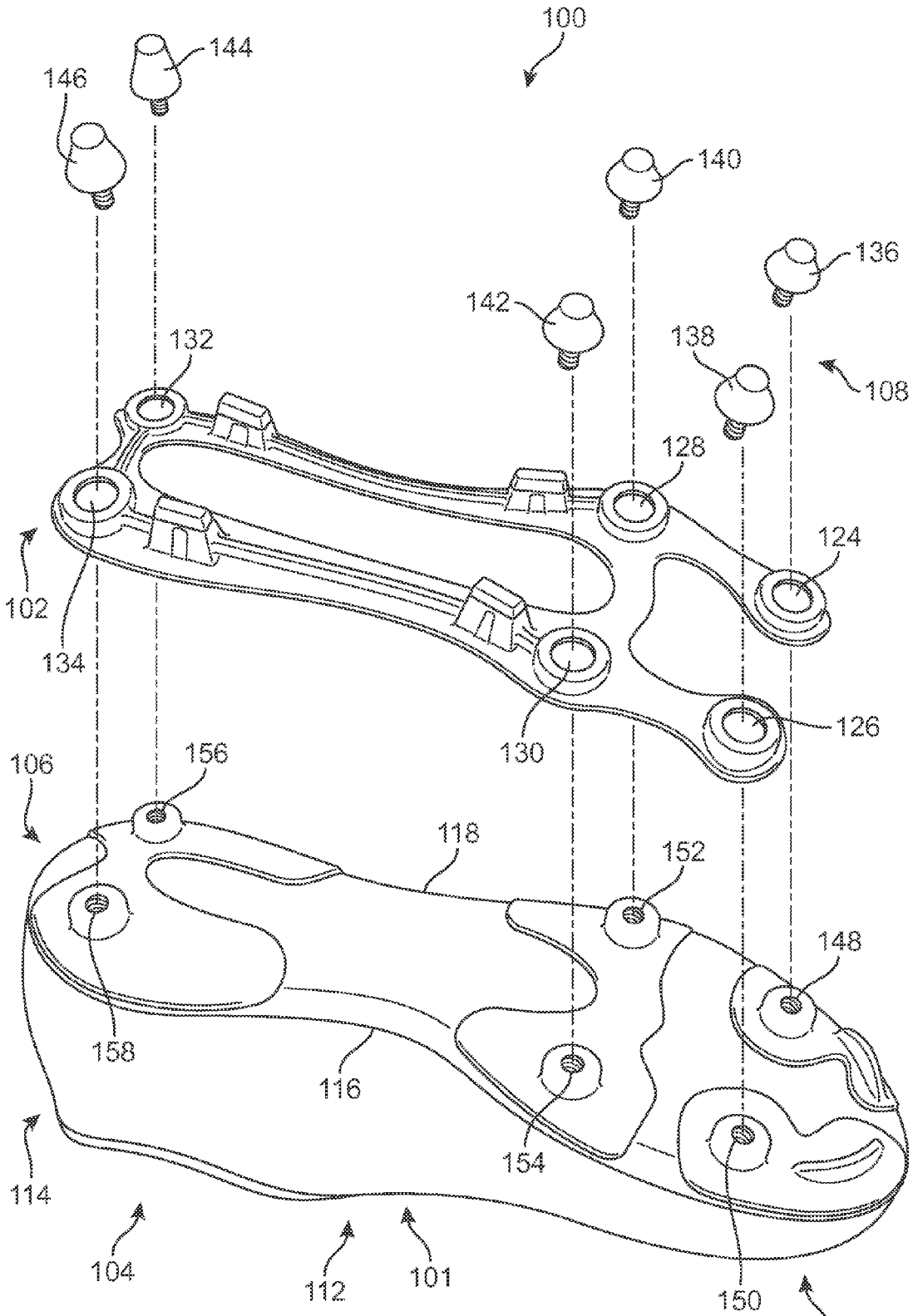
FIG. 1 is an exploded isometric view of an embodiment of an article of footwear with an interchangeable chassis system.

FIG. 1 is an isometric view of an embodiment of components of an interchangeable chassis for an article of footwear 104. In some embodiments, this may be referred to as an interchangeable chassis system ("chassis system") 100. In some embodiments, chassis system 100 may include: an article of footwear 104, a first chassis 102, a plate 106, and a removable cleat set 108. In FIG. 1, chassis system 100 is detached from article of footwear 104 to emphasize the various components of chassis system 100. In other embodiments, chassis system 100 may include additional components. In other embodiments, chassis system 100 may include fewer components.

Article of footwear 104 may include an upper 101 as well as various sole provisions. In different embodiments, sole provisions may include different components. For example, sole provisions may include an outsole, a midsole, and/or an insole. A sole provision may also comprise a plate 106 and/or chassis. Various sole provisions may be secured to upper 101 and extend between the foot and the ground when article of footwear 104 is worn. In some embodiments, one or more of these components may be optional.

Generally, upper 101 may be any type of upper. In particular, upper 101 may have any design, shape, size and/or color. For example, in embodiments where article of footwear 104 is a basketball shoe, upper 101 could be a high top upper that is shaped to provide high support on an ankle. In embodiments where article of footwear 104 is a running shoe, upper 101 could be a low top upper.

Article of footwear 104 including chassis system 100 may be configured as various kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article of footwear 104 may be configured as various other kinds of non-sports related footwear, including, but not limited to: slippers, sandals, high heeled footwear, loafers as well as any other kinds of footwear, apparel and/or sporting equipment (e.g., gloves, helmets, etc.). In some embodiments, plate 106 may be integrated into article of footwear 104, and need not be detachable from an article of footwear 104. In some embodiments, plate 106 may comprise various layers and/or portions. In one embodiment, plate 106 may include an outsole. In other embodiments, plate 106 may include a lasting board cover. In some embodiments, plate 106 may comprise an outsole attached to a lasting board cover. In other embodiments, plate 106 may be a single element. In other embodiments, plate 106 may comprise a plurality of pieces and/or layers. Plate 106 may assume any shape, including various thicknesses and styles. In still further embodiments, at least some portions of plate 106 could be detachable from article of footwear 104.

Referring to FIG. 1, for purposes of reference, article of footwear 104 in this description may comprise a forefoot region 110, a midfoot region 112, and a heel region 114. Forefoot region 110 may be the region generally corresponding with the toes of a foot. Midfoot region 112 may be the region generally corresponding with the arch of a foot. Likewise, heel region 114 may be the region generally corresponding with the heel of a foot. In addition, article of footwear 104 may include a medial side 116 and a lateral side 118. In particular, medial side 116 and lateral side 118 may be disposed on opposite sides of article of footwear 104. Furthermore, both medial side 116 and lateral side 118 may extend through forefoot region 110, midfoot region 112, and heel region 114.

It should be noted that the terms forefoot region 110, midfoot region 112, and heel region 114, as well as medial side 116 and lateral side 118, can be applied to individual components of an article of footwear 104, such as plate 106, first chassis 102, a sole structure and/or an upper 101. It will be understood that forefoot region 110, midfoot region 112, and heel region 114 are only intended for purposes of description and are not intended to demarcate precise regions of the components. Likewise, medial side 116 and lateral side 118 are intended to represent generally two sides of a component, rather than precisely demarcating the component into two halves.

For consistency and convenience, directional adjectives are employed throughout this detailed description corresponding to the illustrated embodiments. The term forward direction refers to a direction toward the front of a foot, or toward the toes, when article of footwear 104 is worn on the foot. The term rearward direction refers to a direction extending toward the back of a foot, or toward the heel, when article of footwear 104 is worn on the foot.

The term "longitudinal" as used throughout this detailed description and in the claims refers to a direction extending a length of an article of footwear 104. In some embodiments, the longitudinal direction may extend from a forefoot portion 110 to a heel portion 114 of article of footwear 104. Also, the term "lateral" as used throughout this detailed description and in the claims refers to a direction extending a width of article of footwear 104. In other words, the lateral direction may extend between medial side 116 and lateral side 118 of article of footwear 104. Likewise, the term "distal" refers to a portion of a component that is further from a portion of a foot when an article of footwear 104 is worn.

It should be understood that chassis system 100 discussed in this specification may apply to a single article of footwear 104, as well as a pair of footwear. Any components that may be discussed as related to one article of footwear 104 may be similarly related to a second, complementary article of footwear 104. The term complementary, as used through this specification, refers to the association of a left article of footwear 104 with a right article of footwear 104, and vice-versa. However, in discussing the system as applied to a pair of footwear it should be understood that each article of footwear 104 may be configured independently through application of an interchangeable chassis system 100. Complementary articles of footwear need not include identical chassis or chassis system 100 components.

The term chassis, as used throughout this specification and the claims, refers to a device configured to attach to a portion of an article of footwear 104 that can provide structural support to article of footwear 104. In some embodiments, first chassis 102 may be attached to plate 106. Plate 106 may be attached to article of footwear 104. In different embodiments, first chassis 102 may cover any desired portion of article of footwear 104. In other embodiments, first chassis 102 may cover different portions of plate 106. In some embodiments, first chassis 102 can be disposed along forefoot region 110 of plate 106. In other embodiments, first chassis 102 may be disposed along midfoot region 112 of plate 106. In other embodiments, first chassis 102 may be disposed along heel region 114 of plate 106. In other embodiments, first chassis 102 may be disposed along two or more regions of plate 106.

In different embodiments, the geometry of first chassis 102 may vary. In some embodiments, for example, chassis 102 could be comprised of a generally solid or continuous piece without spaces or openings. In other embodiments, however, first chassis 102 could comprise a frame-like structure that includes various openings, spaces and/or otherwise separated regions or portions. In the embodiment depicted in FIG. 1, first chassis 102 may comprise a generally frame-like structure.

A chassis may include provisions for attaching to article of footwear 104. In some embodiments, first chassis 102 may use an attachment system that can be combined with another attachment system in article of footwear 104. Some embodiments can contemplate the use of cleats that are attached to article of footwear 104 with a threaded fastener. One embodiment of chassis system 100 may include a mechanism for attaching first chassis 102 to article of footwear 104 using threaded cleats.

In particular, first chassis 102 can include a plurality of through-holes. A through-hole may be an opening in first chassis 102. In some embodiments, the opening may permit attachment of first chassis 102 to a plate 106. In one embodiment, the through-hole may be configured to receive fastener portions of removable cleats.

In some embodiments, there may be at least two through-holes. In one embodiment, there may be six through-holes. In such an embodiment, a first chassis 102 may include a first through-hole 124, a second through-hole 126, a third through-hole 128, a fourth through-hole 130, a fifth through-hole 132, and a sixth through-hole 134. In some embodiments, first through-hole 124, second through-hole 126, third through-hole 128, fourth through-hole 130, fifth through-hole 132, and sixth through-hole 134 are constructed in such a way that a small fastener could be inserted through each through-hole.

As seen in FIG. 1, article of footwear 104 may also include a first removable cleat 136, a second removable cleat 138, a third removable cleat 140, a fourth removable cleat 142, a fifth removable cleat 144, and a sixth removable cleat 146, referred to collectively as removable cleat set 108. Although the embodiment of FIG. 1 depicts six removable cleats, other embodiments could incorporate any other number of removable cleats. In some embodiments, the number of removable cleats used to fasten first chassis 102 to plate 106 may equal to the number of through holes provided on first chassis 102.

The article of footwear 104 may also include provisions for engaging the removable cleats to plate 106. In some embodiments, plate 106 may include one or more cleat receptacles. In the embodiment depicted in FIG. 1, plate 106 may include six cleat receptacles comprising of a first cleat receptacle 148, a second cleat receptacle 150, a third cleat receptacle 152, a fourth cleat receptacle 154, a fifth cleat receptacle 156, and a sixth cleat receptacle 158.

Figure 2:
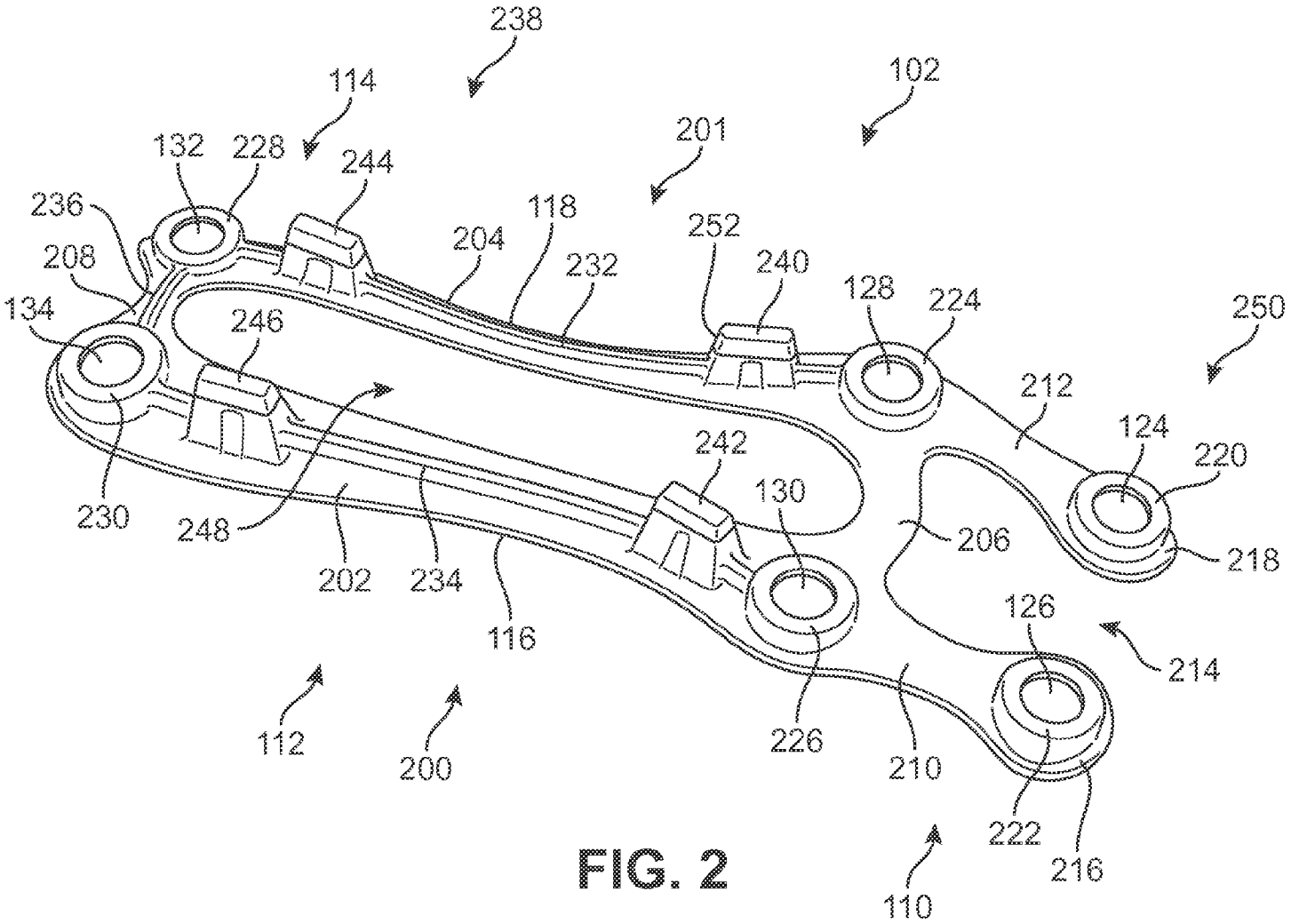
FIG. 2 is an isometric view of an embodiment of a first chassis.

A chassis may have provisions for adding support and strength to an article of footwear. FIG. 2 is an isometric view of an embodiment of a first chassis 102. Referring now to FIG. 2, in some embodiments, first chassis 102 can comprise any shape. In other embodiments, first chassis 102 may have a generally rectangular shape. In other embodiments, there may be a main body of first chassis 102, which includes the larger shape, and portions that extend outward from the main body. In some embodiments, there may be segments of first chassis 102 that can extend beyond the main body.

In some embodiments, the segments of the main body of first chassis 102 may border one or more spaces. In different embodiments, the spaces may vary in shape and size. In the case of a generally rectangular shaped first chassis 102, one or more of the spaces may also be rectangular shaped.

It should be understood that the chassis properties discussed in this specification may apply to all the possible chassis types described. Any description, properties, or features directed toward first chassis 102 may be applied to a second, third, fourth, or any other chassis.

In some embodiments, first chassis 102 may include one or more members. A member may be a segment of material. In some embodiments, there may be a plurality of members. In one embodiment, there may be two members, comprising a medial member 200 and a lateral member 201. In some embodiments, medial member 200 may be disposed along medial side 116 of first chassis 102. Lateral member 201 may be disposed along lateral side 118 of first chassis 102.

In different embodiments, each member could extend through different regions of first chassis 102. In some embodiments, each member may comprise a segment of material extending in a substantially longitudinal manner through different regions of first chassis 102. In some embodiments, for example in the embodiment depicted in FIG. 2, medial member 200 may extend from forefoot region 110 to heel region 114. In other embodiments, medial member 200 may extend only through forefoot region 110. In still other embodiments, medial member 200 may extend only through heel region 114. Likewise, in different embodiments, lateral member 201 could be extended through any combination of regions, including the various configurations already discussed for medial member 200. In one embodiment, both medial member 200 and lateral member 201 may be full length members that extend from forefoot region 110 to heel region 114.

Medial member 200 and lateral member 201 may be arranged in any orientation with respect to one another. In some embodiments, medial member 200 and lateral member 201 could be substantially parallel to one another. In other embodiments, medial member 200 and lateral member 201 could be oriented at an angle less than 180 degrees with respect to one another (e.g., in a non-parallel manner). In the embodiment depicted in FIG. 2, medial member 200 and lateral member 201 may be approximately parallel with one another.

In some embodiments, medial member 200 may be dissimilar from lateral member 201. In other embodiments, medial member 200 may be substantially similar to lateral member 201. In some embodiments, members may be of different lengths, materials, shape, thickness, position, structure, and/or include distinct features. The perimeter of the members may be straight or may be curved. In different embodiments, the member shape, material and/or width of the members may be adjusted to permit varying flexibility to first chassis 102.

In some embodiments, medial member 200 and lateral member 201 may be characterized as including one or more portions. In other embodiments, one member may have a different number or arrangement of portions than that of another member. In one embodiment, each member may comprise two portions. Medial member 200 may include a medial forward portion 210 and a medial rearward portion 202. Lateral member 201 may include a lateral forward portion 212 and a lateral rearward portion 204. In one embodiment, lateral forward portion 212 and medial forward portion 210 may extend along forefoot region 110 of first chassis 102 in a generally longitudinal direction. In another embodiment, lateral rearward portion 204 and medial rearward portion 202 may extend along forefoot region 110 of first chassis in a generally longitudinal direction.

The forward portions may be disposed in various orientations along the member. In some embodiments, lateral forward portion 212 and medial forward portion 210 could be substantially parallel to one another. In other embodiments, lateral forward portion 212 and medial forward portion 210 could be oriented at an angle less than 180 degrees with respect to one another (e.g., in a non-parallel manner). In the embodiment depicted in FIG. 2, lateral forward portion 212 and medial forward portion 210 may be approximately parallel with one another.

In different embodiments, each forward portion may be disposed in different regions of a member. In some embodiments, for example in the embodiment depicted in FIG. 2, lateral forward portion 212 and medial forward portion 210 may be disposed only in forefoot region 110 of first chassis 102.

In different embodiments, the support structure of first chassis 102 may be adjusted by varying the length of the forward portions. In some embodiments, medial forward portion 210 and/or lateral forward portions 212 may be any length. In other embodiments, medial forward portion 210 may be longer than lateral forward portion 212. In some embodiments, lateral forward portion 212 may be longer than medial forward portion 210. In the embodiment of FIG. 2, each of the forward portions may be approximately the same length.

In some embodiments, the shape of the forward portions may be configured to include one or more curves. In different embodiments, a different forward portion shape can provide different types of support and flexibility to article of footwear 104. In some embodiments, as seen in FIG. 2, lateral forward portion 212 may have a portion that is narrow relative to its ends. In other embodiments, lateral forward portion 212 may taper and become increasingly narrow as it extends outward from first cross-member 206. In still other embodiments, lateral forward portion 212 may comprise a more narrow middle area and then expand outward to form a wider portion. In some embodiments, the wider portion may be at a forward end 250 of lateral forward portion 212. In one embodiment, the wider portion may be a circular region, disposed around first through-hole 124. In the embodiment depicted in FIG. 2, a lateral circular region 218 can be seen disposed around first through-hole 124. In other embodiments, the forward regions disposed around the through-holes may differ in shape, thickness, width, material, or in other characteristics. Likewise, in different embodiments, the shape of medial forward portion 210 may curve as it extends from first cross-member 206, including the various possible configurations already discussed for lateral forward portion 212. In FIG. 2, a medial circular region 216 can also be seen disposed around second through-hole 126 at a forward end of medial forward portion 210.

In different embodiments, forward portions could terminate in different ways. In some embodiments, the forward ends of lateral forward portion 212 and/or medial forward portion 210 may rejoin another part of first chassis 102. In some embodiments, lateral forward portion 212 and/or medial forward portion 210 may each extend outward, like an arm, and remain unattached to any further part of first chassis 102. In one embodiment, as depicted in FIG. 2, lateral forward portion 212 may extend forward and terminate in the forefoot region 110. Medial forward portion 210 may extend forward and terminate in the heel region 114.

The rearward portions may be disposed in various orientations along the member. In some embodiments, medial rearward portion 202 and lateral rearward portion 204 could be substantially parallel to one another. In other embodiments, medial rearward portion 202 and lateral rearward portion 204 could be oriented at an angle less than 180 degrees with respect to one another (e.g., in a non-parallel manner). In the embodiment depicted in FIG. 2, medial rearward portion 202 and lateral rearward portion 204 may be approximately parallel with one another.

In different embodiments, each rearward portion may be disposed in different regions of a member. In some embodiments, for example in the embodiment depicted in FIG. 2, medial rearward portion 202 and lateral rearward portion 204 may extend in part along the rearward end of first chassis 102. In still other embodiments, medial rearward portion 202 and lateral rearward portion 204 may be disposed only in midfoot region 112 of first chassis 102. In other embodiments, medial rearward portion 202 and lateral rearward portion 204 may be disposed only in heel region 114 of first chassis 102. In the embodiment of FIG. 2, medial rearward portion 202 and lateral rearward portion 204 are disposed along both midfoot region 112 and heel region 114.

In different embodiments, rearward portions could terminate in different ways. In some embodiments, the rear ends of medial rearward portion 202 and lateral rearward portion 204 may rejoin another part of first chassis 102. In other embodiments, medial rearward portion 202 and lateral rearward portion 204 may each extend outward, like an arm, and remain unattached to any further part of first chassis 102. In one embodiment, as depicted in FIG. 2, lateral rearward portion 204 may extend rearward and may terminate near the area corresponding to the heel of the foot. Additionally, in the embodiment depicted in FIG. 2, medial rearward portion 202 may extend rearward and may terminate near the area corresponding to the heel of the foot.

In different embodiments, each portion could attach to another portion of medial member 200 and/or lateral member 201. In some embodiments, for example in the embodiment depicted in FIG. 2, lateral forward portion 212 may attach to lateral rearward portion 204 in a continuous manner. Similarly, other portions may also be joined in various manners.

In some embodiments, first chassis 102 may include provisions for associating medial member 200 to lateral member 201. In some embodiments, medial member 200 and lateral member 201 may be attached rigidly. In other embodiments, the attachment may be formed integrally in first chassis 102. In other embodiments, medial member 200 and lateral member 201 may be attached using a separate piece or pieces of material. In some embodiments, the attachment may be permanent. In other embodiments, the attachment between the members may be impermanent.

In one embodiment, the manner of attachment may include the use of cross-members. A cross-member may be a segment extending between medial member 200 and lateral member 201. In the embodiment shown in FIG. 2, there is a first cross-member 206 and a second cross-member 208.

In different embodiments, the number of cross-members could vary. In some embodiments, there may be a greater number of cross-members than members. In the embodiment shown in FIG. 2, there are two cross-members, comprised of first cross-member 206 and second cross-member 208. In other embodiments, there may be a fewer number of cross-members or a greater number of cross-members.

In different embodiments, each cross-member could extend through different regions of first chassis 102. First cross-member 206 and second cross-member 208 may be disposed in one or more regions of first chassis 102. For example, in some embodiments, first cross-member 206 may be disposed in midfoot region 212. In other embodiments, second cross-member 208 may be disposed in heel region 214 or forefoot region 210. In the embodiment shown in FIG. 2, first cross-member 206 may be disposed toward the forward end 250 of first chassis 102. Second cross-member 208 may be disposed along heel region 214 of first chassis 102.

The two cross-members may be arranged in any orientation with respect to the two members. In different embodiments, first cross-member 206 may extend from medial side 116 to lateral side 118 of first chassis 102. In the embodiment of FIG. 2, first cross-member 206 extends in a substantially lateral manner from medial member 200 to lateral member 201. First cross-member 206 may extend laterally across from medial member 200 to lateral member 201, or first cross-member 206 may extend across the members at varying angles. For example, in some embodiments first cross-member may extend from medial member 200 to lateral member 201 in a substantially diagonal manner. Likewise, in different embodiments, second cross-member 208 could extend at any orientation across the two members, including the various possible configurations already discussed for first cross-member 206.

The two cross-members may be arranged at various angles with respect to one another. In some embodiments, the cross-members may be disposed so that first cross-member 206 extends across the two members in a diagonal fashion, and second cross-member 208 is approximately perpendicular to the two members. In one embodiment, first cross-member 206 and second cross-member 208 may be approximately parallel with one another. In another embodiment, first cross-member 206 and second cross-member 208 may be approximately perpendicular to one another.

First cross-member 206 and second cross-member 208 may be of different lengths, materials, shape, thickness, position, structure, and/or include distinct features. The lengths, materials, shape, thickness, position, structure, and/or features of the cross-members may provide varying levels of bending for different regions of article of footwear 104. First cross-member 206 may be dissimilar from second cross-member 208 or may be substantially similar in these respects.

Varying the width, shape, and/or appearance of first cross-member 206 and second cross-member 208 may alter the rigidity of portions of first chassis 102. In different embodiments, first cross-member 206 and second cross-member 208 may comprise a different shape. In some embodiments, the shape of each cross-member may be approximately straight or may be curved in some manner. In the embodiment of FIG. 2 first cross-member 206 includes a relatively small curve along its middle section. The curve angles slightly toward the forward end 250 of first chassis 102. Second cross-member 208 remains relatively straight as it extends across from medial member 200 to lateral member 201.

The overall structure of first chassis 102 can be modified by further varying the shape of each of the cross-members. In other embodiments, the cross-members may be different widths, lengths, and thickness. Changes to the shape of each cross-member can provide different levels of reinforcement and rigidity to article of footwear 104. In some embodiments, first cross-member 206 may have a portion that is narrow relative to the ends of the cross-members. In some embodiments, first cross-member 206 may comprise a narrow region that lies between two wider portions of material that are attached to medial member 200 and lateral member 201. In some embodiments, the wider portions may converge with the through-holes disposed along the members. Likewise, in different embodiments, second cross-member 208 could have any shape, including the possible shapes already discussed for first cross-member 206.

In different embodiments, the cross-members may be attached to medial member 200 and lateral member 201 in various ways. In some embodiments, the cross-members may be removably attached or they may be integrally attached. In the embodiment of FIG. 2, first cross-member 206 and second cross-member 208 are integrally molded to medial member 200 and to lateral member 201.

In different embodiments, first chassis 102 may include provisions for releasably attaching first chassis 102 to plate 106. For purposes of this specification, releasably attaching should be understood to mean attaching and/or detaching first chassis 102 to plate 106, where the releasable attachment of first chassis 102 to plate 106 may be accomplished by a typical end-user with relatively simple and readily available tools. In some embodiments, the tools may comprise pre-existing hardware.

In different embodiments, first chassis 102 can include structural provisions for secure attachment to plate 106. In some embodiments, there may be one or more through-holes in first chassis 102 to help optimize cleat placement and attachment. In the embodiment shown in FIG. 2, there are six through-holes, comprised of first through-hole 124, second through-hole 126, third through-hole 128, fourth through-hole 130, fifth through-hole 132, and sixth through-hole 134.

In different embodiments, each through-hole could be disposed through different regions of first chassis 102. In some embodiments, through-holes may be disposed along medial member 200 and/or lateral member 201. In some embodiments, for example in the embodiment depicted in FIG. 2, first through-hole 124, second through-hole 126, third through-hole 128, and fourth through-hole 130 may be disposed along forefoot region 110. Specifically, in some embodiments, first through-hole 124 and second through-hole 126 may be disposed toward the front of forefoot region 110 of first chassis 102, forward of third through-hole 128 and fourth through-hole 130. Additionally, in some embodiments, third through-hole 128 and fourth through-hole 130 may be disposed in the area of forefoot region 110 associated with the ball of a foot. In some embodiments, fifth through-hole 132 and sixth through-hole 134 may be disposed toward the rearward end of first chassis 102.

The through-holes may be arranged in any orientation with respect to one another. In the embodiment depicted in FIG. 2, for example, first through-hole 124 and second through-hole 126 may be arranged in a generally lateral orientation. Also in the embodiment third through-hole 128 and fourth through-hole 130 may be arranged in a generally lateral orientation. Further in the embodiment, fifth through-hole 132 and sixth through-hole 134 may be arranged in a generally lateral orientation. Also in the embodiment of FIG. 2, first through-hole 124, third through-hole 128, and fifth through-hole 132 may be arranged in a generally longitudinal manner along lateral side 118 of first chassis 102. Likewise, second through-hole 126, fourth through-hole 130, and sixth through-hole 134 may be arranged in a generally longitudinal manner along medial side 116 of first chassis 102. In other embodiments, first through-hole 124 and second through-hole 126 may be arranged in a diagonal orientation. Likewise, other through-holes may be disposed at diagonals from one another.

In some embodiments, first chassis 102 can include additional provisions to permit firmer attachment to plate 106. In some embodiments, first chassis 102 may include flanges. Flanges may be portions of material that protrude distally from the surface of first chassis 102. In one embodiment, there are six flanges, comprising a first flange 220, a second flange 222, a third flange 224, a fourth flange 226, a fifth flange 228, and a sixth flange 230.

In different embodiments, each through-hole could be disposed along different regions of first chassis 102. In some embodiments, a flange may be disposed around each of the openings of the through-holes. In one embodiment, there is one flange for every through-hole. As depicted in FIG. 2, first flange 220 is disposed around first through-hole 124, second flange 222 is disposed around second through-hole 126, third flange 224 is disposed around third through-hole 128, fourth flange 226 is disposed around fourth through-hole 130, fifth flange 228 is disposed around fifth through-hole 132, and sixth flange 230 is disposed around sixth through-hole 134. In some embodiments, there may be a through-hole without a corresponding flange. In other embodiments, there may be one or more flanges disposed on first chassis 102 without a corresponding through-hole.

In different embodiments, the flanges may comprise different shapes. In some embodiments, for example in the embodiment of FIG. 2, first flange 220 may be shaped in such a manner as to provide substantially continuous contact with the removable cleats. First flange 220 may include a generally round shape including, in at least some embodiments, an approximately circular outer periphery. Likewise, in different embodiments, the other flanges could be shaped in a similar way.

Referring to FIGS. 1 and 2, in some embodiments, first chassis 102 may be selected according to one or more types of ground surfaces on which first chassis 102 may be used. Examples of ground surfaces include, but are not limited to: natural turf, synthetic turf, dirt, natural grass, soft natural grass, as well as other surfaces. In order to maximize a user's performance on various surfaces and/or surface conditions, first chassis 102 may include provisions for controlling the level of traction between article of footwear 104 and the ground. In some embodiments, one such provision may be a cleat member, which is intended to provide additional traction between an article of footwear 104 and a given surface by way of surface friction. For purposes of this detailed description and the claims, the term cleat member, or cleat, is an element disposed on a component or on an article of footwear 104 that increases traction through penetration of a ground surface. Typically, cleat sets and/or individual cleats may be configured for football, soccer, baseball, running, or any type of activity that requires traction. Cleats may be integrally formed in article of footwear 104, or they may be detachable. For purposes of this specification and claims, cleats that are integrally formed on article of footwear 104 or on a related component may be referred to as fixed cleats. Cleats that are detachable may be referred to as removable cleats.

Various chassis cleat configurations may allow a user to customize the type and level of traction applied. Different chassis may include different configurations of cleats. In some embodiments, the chassis may be provided with a cleat set comprising a plurality of cleats.

Generally, a cleat set and/or individual cleats may be attached to a chassis in any manner. In some cases, first chassis 102 may be provided with a first cleat set comprising one or more fixed cleats ("first fixed cleat set") 238, as seen in FIG. 2. In other cases, first chassis 102 may include a cleat set comprising one or more removable cleats ("removable cleat set") 108. In some embodiments, a chassis may include both a first fixed cleat set 238 and a removable cleat set 108.

In different embodiments, fixed cleats can vary in shape, size, length, width, and thickness. In one embodiment, there may be one or more fixed cleats that are generally round in shape. For purposes of this description, this type of fixed cleat will be referred to as a round fixed cleat. In another embodiment, there may be one or more fixed cleats that are generally bladed in shape. For purposes of this description, this type of fixed cleat will be referred to as a bladed fixed cleat.

In some cases, first chassis 102 may comprise a first fixed cleat set 238, including a plurality of fixed cleats. In one case, first fixed cleat set 238 may comprise four fixed cleats, including a first fixed cleat, a second fixed cleat, a third fixed cleat, and a fourth fixed cleat. In the embodiment shown in FIG. 2, first fixed cleat set 238 comprise a first bladed fixed cleat 240, a second bladed fixed cleat 242, a third bladed fixed cleat 244, and a fourth bladed fixed cleat 246.

In different embodiments, each bladed fixed cleat may be disposed along different regions of first chassis 102. For example in the embodiment depicted in FIG. 2, first bladed fixed cleat 240 may be disposed along lateral member 201 in midfoot region 112, rearward of third through-hole 128. In one embodiment, second bladed fixed cleat 242 may be disposed along medial member 200 in midfoot region 112, rearward of fourth through-hole 130. Third bladed fixed cleat 244 may be disposed along lateral member 201 in heel region 114, forward of fifth through-hole 132. Fourth bladed fixed cleat 246 may be disposed along medial member 200 in heel region 114, forward of sixth through-hole 134.

In some embodiments, the spacing between fixed cleats may be varied. Fixed cleats may be arranged in any orientation with respect to one another. In some embodiments, first bladed fixed cleat 240 may be closer to third bladed fixed cleat 244 than second bladed fixed cleat 242 is to fourth bladed fixed cleat 246. Likewise, in different embodiments, other bladed fixed cleats may be closer or farther apart.

In different embodiments, first bladed fixed cleat 240, second bladed fixed cleat 242, third bladed fixed cleat 244, and fourth bladed fixed cleat 246 may vary in their geometry. In some embodiments, there may be one or more relatively small undulations along medial side 116 and/or lateral side 118 of a bladed fixed cleat surface. In one embodiment, there may be one undulation on medial side 116 and another undulation on lateral side 118. In other embodiments, the bladed cleat may change size as it extends away from first chassis 102. In one embodiment, the cleat may diminish in size as it extends away from first chassis 102. For example, in some embodiments, fixed cleats may be widest at the cleat base and narrowest at the cleat tip.

In different embodiments, a fixed cleat may be comprised of various materials. In one embodiment, a fixed cleat may be constructed of the same material as first chassis 102. Some embodiments may include a first fixed cleat set 238 configured as a relatively large protrusion of material from the bottom of first chassis 102. In other embodiments, the fixed cleat may be an extension of first chassis 102 material. In other embodiments, a fixed cleat may be constructed of a different material from first chassis 102. Additionally one fixed cleat need not be constructed of the same material as a second fixed cleat. Fixed cleat material may be comprised of a variety of materials, including, but not limited to, rubber, hard plastic, or metal.

In some embodiments, a fixed cleat may include multiple materials. In other embodiments, there may be sections of the fixed cleat that are comprised of one material and another section that is comprised of another material. In other embodiments, there may be an upper layer of material on the fixed cleats of the first fixed cleat set 238 that differs from other layers. In some embodiments, for example the embodiments of FIGS. 2 and 3, this may comprise a wear-resistant cap 252 that provides the fixed cleat with additional protection against external forces and elements.

In some embodiments, first chassis 102 may comprise one or more distinct types of fixed cleats that have various characteristics. Different characteristics may provide for different types of traction with a surface. Examples of different characteristics include, but are not limited to: cleat geometry, cleat height, cleat diameter, material rigidity as well as other characteristics. In some cases, first chassis 102 may comprise at least two cleats with distinct types of cleat members, each having different characteristics. In one case, first fixed cleat set 238 may include one or more fixed cleats that are substantially different in shape from other fixed cleats in first fixed cleat set 238. In other cases, first fixed cleat set 238 of first chassis 102 may include fixed cleats that are each substantially similar in shape to one another. In FIG. 2, first fixed cleat set 238 includes fixed cleats that are substantially similar.

Figure 3:
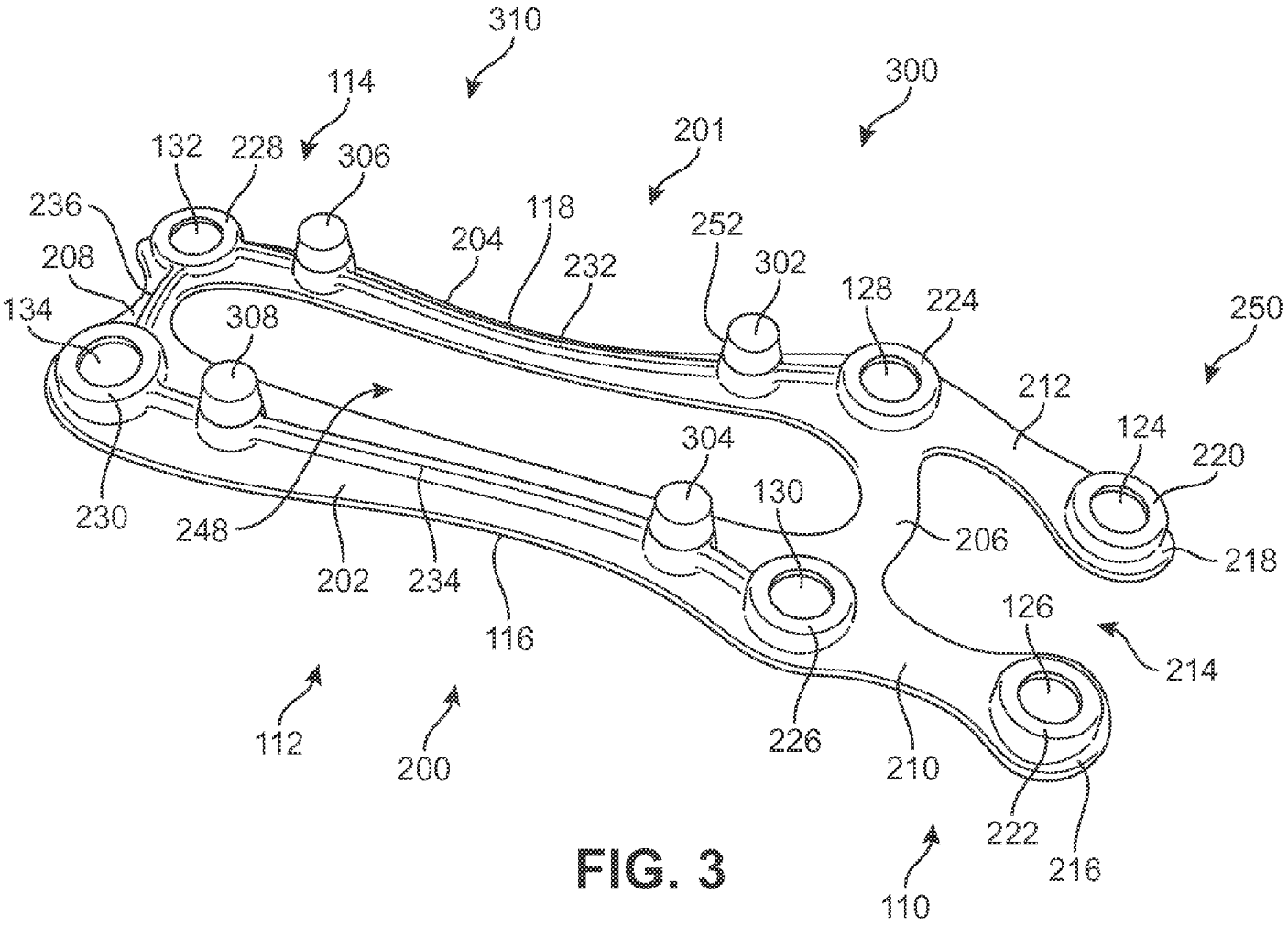
FIG. 3 is an isometric view of an embodiment of a second chassis.

Referring to FIG. 3, an isometric view of an embodiment of a second chassis 300 is shown. In contrast to first chassis 102, second chassis 300 may not include bladed fixed cleats. Instead, second chassis 300 may include one or more round fixed cleats. In one embodiment second chassis may include four round fixed cleats, comprising a second fixed cleat set 310. Second fixed cleat set 310 may include a first round fixed cleat 302, a second round fixed cleat 304, a third round fixed cleat 306, and a fourth round fixed cleat 308.

In at least some embodiments, second chassis 300 may share similar features to first chassis 102. For purposes of clarity, like numerals are used to denote like parts. It should be understood that any description, properties, or features directed toward a second chassis 300 may be applied to first chassis 102, or any other chassis.

In different embodiments, each round fixed cleat may be disposed along different regions of second chassis 300. For example in the embodiment depicted in FIG. 3, first round fixed cleat 302 is disposed along lateral member 201 in midfoot region 112, rearward of third through-hole 128. In one embodiment, second round fixed cleat 304 is disposed along medial member 200 in midfoot region 112, rearward of fourth through-hole 130. Third round fixed cleat 306 is disposed along lateral member 201 in heel region 114, forward of fifth through-hole 132. Fourth round fixed cleat 308 is disposed along medial member 200 in heel region 114, forward of sixth through-hole 134.

In different embodiments, each fixed cleat may be associated with different rigidities. For example, in FIG. 3, first round fixed cleat 302 may be associated with a first rigidity and second round fixed cleat 304 may be associated with a second rigidity. In some embodiments, the second rigidity may be substantially greater than the first rigidity.

In other embodiments, each fixed cleat in a fixed cleat set may be associated with various rigidities. In some embodiments, a fixed cleat set may comprise fixed cleats of substantially similar rigidities. In some embodiments, first chassis 102 may comprise a first fixed cleat set 238 including fixed cleats of one level of rigidity, and second chassis 300 may comprise a second fixed cleat set 310 including fixed cleats of another level of rigidity.

The differing rigidities of a fixed cleat in a set may be achieved in various ways. As an example, in the embodiment of FIG. 3, first round fixed cleat 302 may comprise a first material and second round fixed cleat 304 may comprise a second material. In this embodiment, first material and second material may be substantially different materials having substantially different rigidities. In particular, first material may be made of a semi-rigid material, including, but not limited to rubber, hard foam, and other deformable materials. In addition, second material may be a substantially rigid material, including, but not limited to plastics, polymers, nylon, polyurethane, and other rigid materials. However, it will be understood that any other materials with increasing levels of rigidity could be used. In still other embodiments, it may be possible to modify the rigidity of one or more individual fixed cleat members by varying the geometry and/or structure of the fixed cleat members.

By varying the rigidity of each fixed cleat, each fixed cleat may deform by a substantially different amount upon contact with a ground surface. This arrangement allows each fixed cleat set to be tuned for maximizing traction with a different type of ground surface. It should be understood that each chassis can be configured to include a different fixed cleat set. In some embodiments, each fixed cleat set may have a rigidity and structure that is optimal for a type of ground surface. The variations in first fixed cleat set 238 of first chassis may, for example, permit a user to better grip a particular ground surface than second fixed cleat set 310.

For example, a first configuration of chassis 102 may include a first fixed cleat set 238 with a relatively low rigidity that is optimized for maximizing traction with a synthetic surface. In another embodiment, a second configuration of chassis 300 may include a second fixed cleat set 310 with a relatively high rigidity that is optimized for maximizing traction with soft natural grass. In another embodiment, a third configuration of a chassis may include a fixed cleat set with an intermediate rigidity that is optimized for maximizing traction with firm natural grass. In addition, in other embodiments, a fourth configuration of chassis may comprise a set of fixed cleats with varying levels of rigidity.

It should be understood that the cleat properties discussed in this specification may apply to the cleat set integrally formed into a chassis, as well as the removable cleats that may be individually attached to chassis system 100. In some embodiments, the removable cleats can also include threaded cleats. Any description or features directed toward the cleats may be applied to the fixed cleats, removable cleats, and the threaded cleats.

Referring to FIGS. 2 and 3, in some embodiments, the chassis may include additional provisions for increasing traction. In order to maximize a user's performance on various surfaces and/or surface conditions, article of footwear 104 may include other provisions for maintain a desired level of traction between article of footwear 104 and the surface. One such provision may be a tread element, which is intended to provide additional traction between an article of footwear 104 and a given surface by way of surface friction. A chassis may include a plurality of tread elements. In one embodiment, a chassis may include be three tread elements, comprising a first rib 232, a second rib 234, and a third rib 236.

Tread elements may penetrate the surface in order to increase traction, though a cleat may increase traction through substantially deeper penetration than a tread element. The particular shape and/or shorter length of a cleat, as opposed to a cleat, can permit the tread to engage with the ground, providing traction that may include the forces of friction.

In different embodiments, each rib could be disposed along different regions of second chassis 300. In some embodiments, for example in the embodiment of FIG. 3, first rib 232 may be disposed along lateral rearward portion 204, extending generally from third flange 224 to fifth flange 228. Second rib 234 may be disposed along medial rearward portion 202, extending generally from fourth flange 226 to sixth flange 230. Third rib 236 may be disposed along second cross-member 206, extending generally from fifth flange 228 to sixth flange 230.

In some embodiments, the tread element may be any size and shape. Through attachment of the chassis to an article of footwear 104, the chassis may provide a desired level of traction for a user. In some embodiments, there may be other tread elements, comprised of various shapes. In one embodiment, first rib 232, second rib 234, and third rib 236 may be of a relatively narrow and thin shape.

In other cases, the tread elements may comprise a plurality of ribs and other types of tread elements. In other cases, second chassis 300 may include only one or two of the three ribs. In other cases, second chassis 300 may include more than three ribs.

In different embodiments, a rib may be constructed of various materials. In some embodiments, first rib 232 may be comprised of the same material as second chassis 300. In another embodiment first rib 232 may be configured as a protrusion of material from the bottom of the chassis. In other embodiments, ribs may be constructed of a different material from second chassis 300. Additionally one rib need not be constructed of the same material as a second rib.

In different embodiments, any other features of a rib may vary. In some embodiments, the ribs may be integrally formed along the chassis. In other embodiments, the ribs may be a detachable portion of the chassis. In some embodiments, the spacing between tread elements and/or ribs may be varied.

Figure 4:
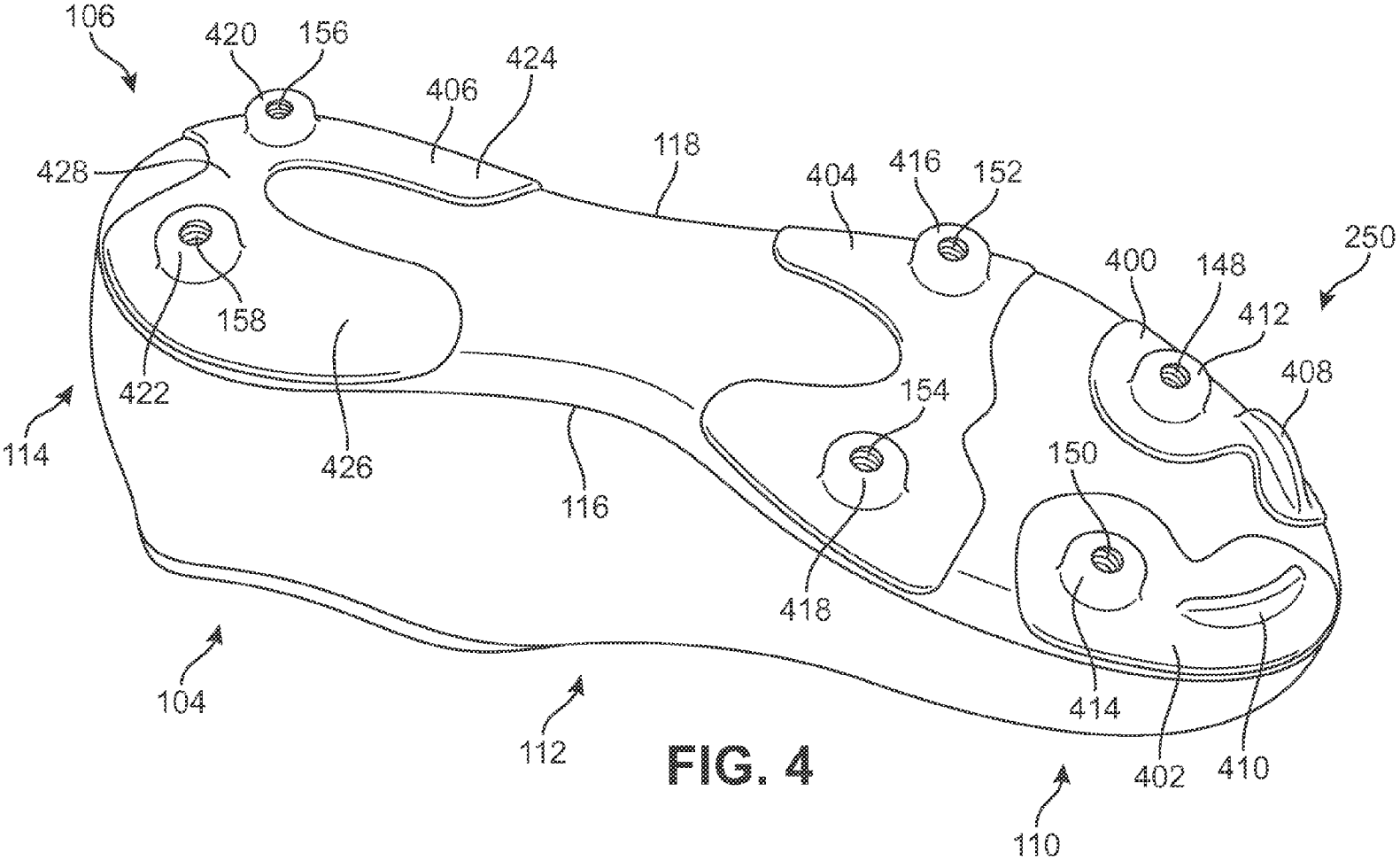
FIG. 4 is an embodiment of a plate.

FIG. 4 is an embodiment of plate 106 attached to article of footwear 104. In some embodiments, plate 106 may extend across one or more regions of the underside of article of footwear 104. In one embodiment, plate 106 may cover portions of forefoot region 110. In other embodiments, plate 106 may cover portions of midfoot region 112 or heel region 114. In the embodiment of FIG. 4, plate extends across forefoot region 110, the midfoot region 112, and the heel region 114.

In different embodiments, plate 106 may be attached to the underside of article of footwear 104. In some embodiments, plate 106 may not be detachable from article of footwear 104. In some embodiments, plate 106 may be attached to article of footwear 104 by attachment to a lasting board layer.

Plate 106 may assume any shape, including various thicknesses and styles. In some embodiments, the shape of plate 106 may generally match the shape of the chassis. In other embodiments, plate 106 may encompass a larger surface area than the chassis. In some embodiments, the shape of plate 106 may substantially correspond to the shape of the underside of article of footwear 104. In other embodiments, portions of plate 106 may have a substantially similar shape to either the chassis or article of footwear 104.

Plate 106 may be constructed of various materials. In some embodiments, plate 106 may be comprised of various types of material with varying levels of rigidity. In some embodiments, plate 106 may be comprised of a material of greater rigidity than first chassis 102. In other embodiments, plate 106 could be substantially less rigid than first chassis 102.

In different embodiments, plate 106 may help provide reinforcement to article of footwear 104 through disposition of one or more portions of material along different regions. In some embodiments, plate 106 may be a single piece of material. In other embodiments, plate 106 may comprise a plurality of separate material segments ("plate segments") attached to article of footwear 104. In one embodiment, plate 106 may comprise four plate segments, including a first plate segment 400, a second plate segment 402, a third plate segment 404, and a fourth plate segment 406. In other embodiments, there may be fewer plate segments or a greater number of plate segments.

Plate segments may be disposed along different regions of article of footwear 104 in order to support attachment of a chassis to article of footwear 104. For example, in the embodiment depicted in FIG. 4, first plate segment 400 and second plate segment 402 may be disposed in forefoot region 110. Also, first plate segment 400 may be disposed on lateral side 118, and second plate segment 402 may be disposed on medial side 116. Further, third plate segment 404 may be disposed rearward of first plate segment 400 and second plate segment 402, near midfoot region 112. Also, fourth plate segment 406 may be disposed in heel region 114, rearward of third plate segment 404.

In different embodiments, first chassis 102 may be attached to plate 106 so that there is substantially continuous contact between first chassis 102 and plate 106 through various regions. In some embodiments, first chassis 102 may have substantially continuous contact with plate 106 along forefoot region 110 only. In another embodiment, first chassis 102 may have substantially continuous contact with plate 106 along heel region 114. In one embodiment, upon attachment of first chassis 102 to plate 106, first chassis 102 may have substantially continuous contact with plate 106 in areas along forefoot region 110, midfoot region 112, and heel region 114. Likewise, second chassis 300 or other chassis may include substantially continuous contact with various regions of plate 106 when attached to plate 106, including those described for first chassis 102.

In some embodiments, first chassis 102 may have substantially continuous contact with various plate segments upon attachment. In other embodiments, first chassis 102 may have substantially continuous contact with portions of various plate segments. In some embodiments, first chassis 102 may have substantially continuous contact with first plate segment 400 or portions of first plate segment 400. In other embodiments, first chassis 102 may have substantially continuous contact with second plate segment 402 or third plate segment 404. In another embodiment, first chassis 102 may have substantially continuous contact with portions of second plate segment 402 or third plate segment 404. In further embodiments, first chassis 102 may have substantially continuous contact with first plate segment 400, second plate segment 402, and third plate segment 404, or portions of each. Likewise, second chassis 300 or other chassis may include substantially continuous contact with various plate segments upon attachment, including those described for first chassis 102.

In some embodiments, plate 106 may include provisions for attachment to the chassis. Some embodiments of plate 106 may include a plurality of cleat receptacles. Cleat receptacles may permit removable cleat attachment to plate 106 and/or article of footwear 104. In one embodiment, there may be the same number of cleat receptacles as the number of through-holes disposed in the chassis. In the embodiment of FIG. 4 there may be six cleat receptacles, comprised of first cleat receptacle 148, second cleat receptacle 150, third cleat receptacle 152, fourth cleat receptacle 154, fifth cleat receptacle 156, and sixth cleat receptacle 158.

In different embodiments, cleat receptacles could be disposed along different regions of plate 106. In some embodiments, as best shown in FIG. 1, when plate 106 is attached to the chassis, first cleat receptacle 148 may be aligned with first through-hole 124, second cleat receptacle 150 may be aligned with second through-hole 126, third cleat receptacle 152 may be aligned with third through-hole 128, fourth cleat receptacle 154 may be aligned with fourth through-hole 130, fifth cleat receptacle 156 may be aligned with fifth through-hole 132, and sixth cleat receptacle 158 may be aligned with sixth through-hole 134.

In different embodiments, one or more cleat receptacles may be arranged in various configurations along plate 106. In some embodiments, there may be one or more cleat receptacles disposed on a plate segment. In other embodiments, there may be no cleat receptacle disposed on a plate segment. In the embodiment of FIG. 4, first cleat receptacle 148 may be disposed on first plate segment 400 and second cleat receptacle 150 may be disposed on second plate segment 402. Also, third cleat receptacle 152 can be disposed on lateral side 118 of third plate segment 404 and fourth cleat receptacle 154 may be disposed on medial side 116 of third plate segment 404. Further, fifth cleat receptacle 156 may be disposed on lateral side 118 of fourth plate segment 406, and sixth cleat receptacle 158 can be disposed on medial side 116 of fourth plate segment 406.

Each plate segment may vary in size and shape and corresponding cleat receptacle disposition. In some embodiments, plate segments of plate 106 may be substantially similar. In other embodiments, plate segments may differ substantially in shape and/or size. For example, in the embodiment of FIG. 4, first plate segment 400 may comprise a rounded portion surrounding first cleat receptacle 148. First plate segment 400 can narrow in the middle and then widen slightly at its forward end. The lateral perimeter of first plate segment 400 may follow the outer curve of plate 106. In some embodiments, second plate segment 402 can comprise a round portion surrounding second cleat receptacle 150. Second plate segment 402 may narrow on one side toward the middle and then widen slightly at its forward end. The medial perimeter of second plate segment 402 may follow the outer curve of plate 106. In some embodiments, third plate segment 404 generally comprises an arch shape, with a wider portion on the two ends and a relatively narrow bridge portion between the two ends. The bridge may curve slightly to correspond to the arch shape. The lateral-sided wider end can be disposed around third cleat receptacle 152 and the medial-sided wider end may be disposed around fourth cleat receptacle 154. In some embodiments, fourth plate segment 406 is generally comprised of two portions connected with a middle portion. Specifically, in one embodiment, first side portion 424 and second side portion 426 of fourth plate segment 406 can be bridged by a relatively narrow portion 428 of fourth plate segment 406. The portions in fourth plate segment may form a continuous piece. In some embodiments, narrow portion 428 can be disposed relatively toward the rearward end of fourth plate segment 406, so that the forward ends of the first side portion 424 and second side portion 426 extend further than the rearward ends.

As described earlier, a tread element may enhance a user's performance on various surfaces and/or surface conditions by providing additional traction between an article of footwear 104 and a surface. In some embodiments, plate 106 may include provisions for increasing traction, such as tread elements. In one embodiment, plate 106 tread elements may comprise a plurality of ridges. In one embodiment, there may be two ridges, including a first ridge 408 and a second ridge 410.

In different embodiments, ridges may be disposed along various regions along plate 106. In some embodiments, a ridge may be formed anywhere along a plate segment. In different embodiments, ridges may be disposed along first plate 400, second plate segment 402, third plate segment 404, and/or fourth plate segment 406. For example, as seen in the embodiment depicted in FIG. 4, first ridge 408 may be disposed along first plate segment 400. As also seen in the embodiment of FIG. 4, second ridge 410 may be disposed along second plate segment 402. In one embodiment, first ridge 408 and second ridge 410 may be disposed toward the forward end of the segment.

In other embodiments, plate 106 may include a different number of ridges. In other embodiments, plate 106 may include more than two ridges. In some embodiments, there may be no ridges or tread elements. In some embodiments, plate 106 may include only one of the two ridges.

In some embodiments, ridges of a plate may be any size and shape. In some embodiments, one or more ridges may be larger than another ridge. In some embodiments, one or more ridges may be curved or may be substantially straight. In other embodiments, a ridge may vary in height along its surface. In the embodiment of FIG. 4, the ends of first ridge 408 and second ridge 410 may be lower than their midpoints.

In different embodiments, a ridge may be constructed of various materials. In some embodiments, first ridge 408 may be comprised of the same material as plate 106. In another embodiment first ridge 408 may be configured as a protrusion of material from plate 106. In other embodiments, ridges may be constructed of a different material from plate 106. Additionally first ridge 408 need not be constructed of the same material as second ridge 410.

In different embodiments, any other features of a ridge may vary. In some embodiments, the ridges may be integrally formed along plate 106. In other embodiments, the ridges may be a detachable portion of plate 106. In some embodiments, the spacing between ridges may be varied.

In different embodiments, the chassis may be removably attachable to plate 106. In some embodiments, plate 106 may include further provisions for securing plate 106 to a chassis. In different embodiments, the cleat receptacles may be formed to include a protrusion of material disposed around the opening of the cleat receptacle. In some embodiments, the protrusion may be formed as a raised knob. In another embodiment, the cleat receptacles of plate 106 may include a plurality of knobs. In one embodiment, there may be six knobs, comprised of a first knob 412, a second knob 414, a third knob 416, a fourth knob 418, a fifth knob 420, and a sixth knob 422.

In different embodiments one or more cleat receptacles of plate 106 may include a corresponding knob. In one embodiment, the contours of a cleat receptacle may generally match the contours of a knob. Other embodiments may include any number of cleat receptacles and knobs. In the embodiment depicted in FIG. 4, each of the six cleat receptacles of plate 106 may be disposed within a corresponding knob. In such an embodiment, first cleat receptacle 148 may be disposed within a first knob 412, second cleat receptacle 150 is disposed within a second knob 414, third cleat receptacle 152 is disposed within a third knob 416, fourth cleat receptacle 154 is disposed within a fourth knob 418, fifth cleat receptacle 156 is disposed within a fifth knob 420, and sixth cleat receptacle 158 is disposed within a sixth knob 422.

In different embodiments, a knob may be constructed of various materials. In some embodiments, first knob 412 may be comprised of the same material as plate 106. In another embodiment, first knob 412 may be configured as a protrusion of material from plate 106. In other embodiments, knobs may be constructed of a different material from plate 106. Additionally one knob need not be constructed of the same material as another knob.

In some embodiments, the knobs may be integrally formed along plate 106. In other embodiments, the knobs may be detachable portions of plate 106.

Figure 5:
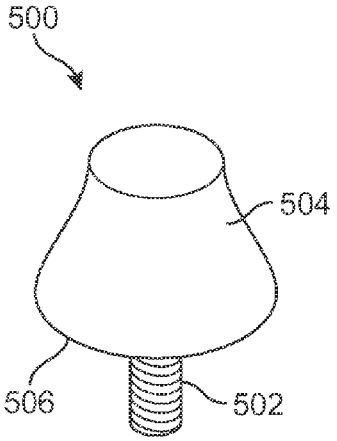
FIG. 5 is a view of an embodiment of a removable cleat.

Chassis system 100 may include provisions for fastening the chassis to plate 106. Some embodiments include provisions to improve the ease with which the chassis selected may be assembled to plate 106 of article of footwear 104 through the use of removable cleats. FIG. 5 is an embodiment of a removable cleat 500.

In some embodiments, removable cleat 500 may be inserted into a through-hole of a chassis and fastened to article of footwear 104. In some embodiments, removable cleat 500 may be inserted into the cleat receptacle of plate 106. In one embodiment, removable cleat 500 may be inserted into the hole of the cleat receptacle, passing through the through-hole of the chassis. This may result in a fastening of the chassis to plate 106. Because some embodiments of the present invention contemplate the use of removable cleats that are attached to the chassis with a threaded fastener, one embodiment of the interchangeable chassis system 100 includes a mechanism for attaching the chassis to plate 106 using the threaded cleats. In one embodiment, additional screws or other fastening mechanisms may not be necessary to attach the chassis to plate 106.

In some embodiments, one or more cleat receptacles may include a hole. In different embodiments, the hole may vary in shape, size, diameter, and surface texture. In some embodiments, the hole may be the receiving area for the removable cleat. In different embodiments, the hole may include threaded portions to engage with a threaded cleat, such as removable cleat 500.

In different embodiments, there may be a generally hollow cylinder disposed within one or more knobs. In some embodiments, for example, first knob 412 may form a cylindrical wall that may be disposed around first cleat receptacle 148. In other embodiments, first cleat receptacle 148 may include threading in the cylinder to engage with a threaded cleat, such as removable cleat 500. Likewise in different embodiments, there may be a cylinder shape within one or more other knobs as already discussed for first knob 412.

FIG. 5 provides an isometric view of an embodiment of removable cleat 500. In this embodiment, removable cleat 500 is also a threaded cleat. For purposes of this description, threaded cleat will be understood to be a type of removable cleat 500. However, it should be noted that not all removable cleats may be threaded. In some embodiments, threaded cleat comprises a threaded lower portion and an upper portion. The threaded portion may be referred to as fastener portion 502. The upper portion, which may include a traction element, may be referred to as head 504. The lower surface of head 504 may be referred to as base 506 of the cleat.

In different embodiments, removable cleat set 108 that is selected by a user may vary. Removable cleats may vary in shape, size, length, width, thickness, material, construction, weight, and can also vary in other aspects. In some embodiments, removable cleat set 108 can include various characteristics. Different characteristics may provide for different types of traction with a surface. Examples of different characteristics include, but are not limited to: cleat geometry, cleat height, cleat diameter, material rigidity as well as other characteristics. In some embodiments, removable cleat set 108 may comprise at least two removable cleats with distinct types of cleat members, each having different characteristics.

In different embodiments, removable cleats 500 may vary in shape. In some cases, removable cleat set 108 may include removable cleats that are each substantially similar in shape. In other cases, removable cleat set 108 may include one or more removable cleats that are substantially different in shape from other removable cleats in removable cleat set 108.

In different embodiments, removable cleat 500 may be constructed of various materials. In some embodiments, removable cleat 500 may comprise the same material as first chassis 102 or second chassis 300. In other embodiments, removable cleat 500 may be constructed of a different material from first chassis 102 or second chassis 300. In still other embodiments, a first removable cleat 136 need not be constructed of the same material as second removable cleat 138 or other removable cleats in removable cleat set 108.

Figure 6:
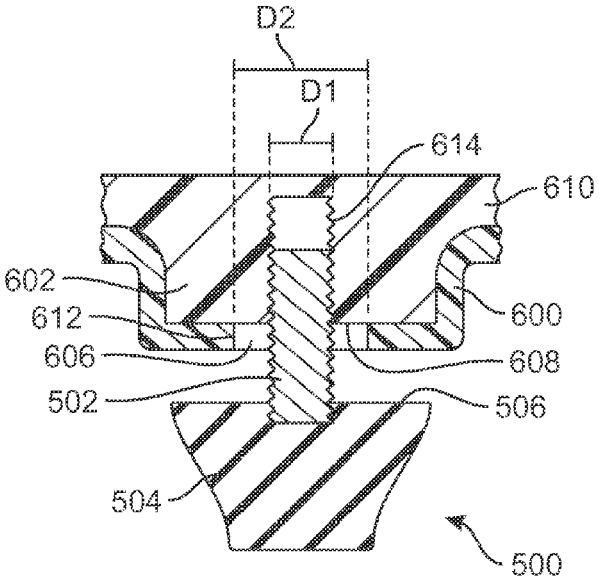
FIG. 6 is an enlarged cut-away view of an embodiment of a chassis with a removable cleat.
Figure 7:
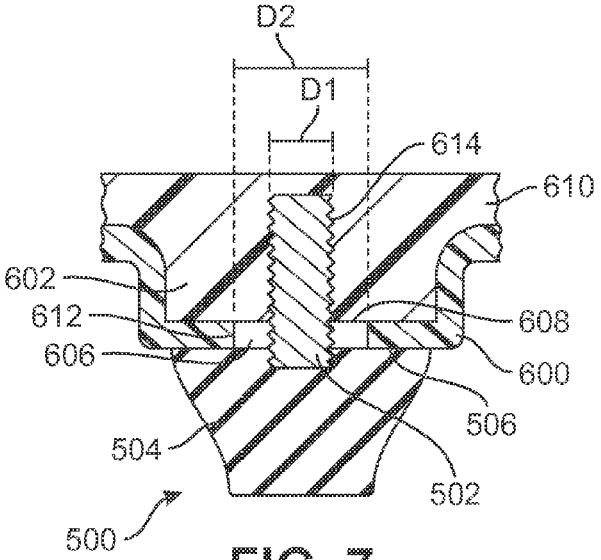
FIG. 7 is an enlarged cut-away view of an embodiment of a chassis with a removable cleat.
Figure 8:
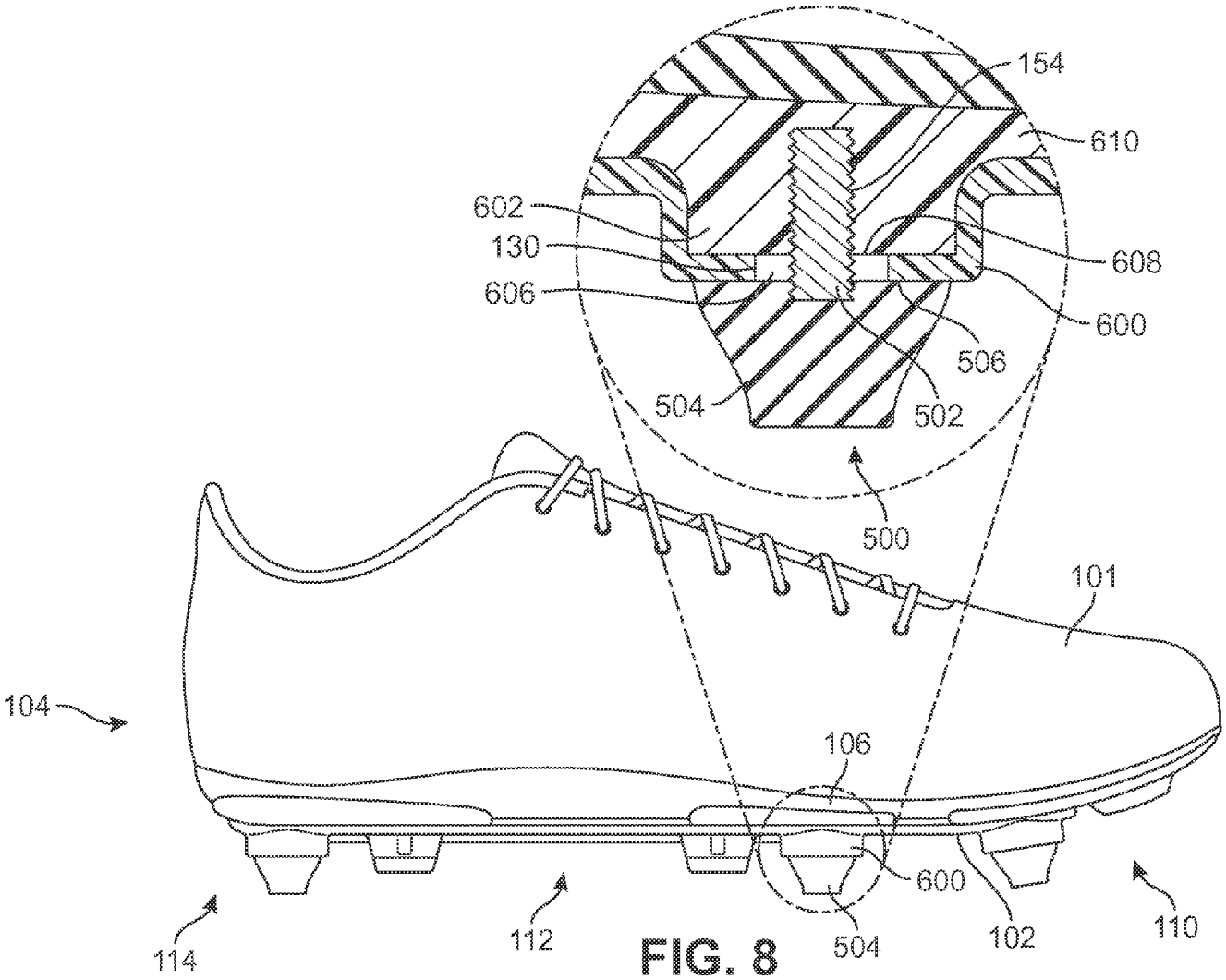
FIG. 8 is a view of an embodiment of an article of footwear with an enlarged cut-away view of an embodiment of a chassis with a removable cleat.

Referring to FIGS. 6, 7 and 8, fastener portion 502 may enter through a through-hole 612 of first chassis 102 and engage a cleat receptacle 614 disposed in a plate segment 610. FIGS. 6 and 7 depict an enlarged cut-away view of an embodiment of first chassis 102 and plate segment 610 with removable cleat 500. In the embodiment of FIG. 6, removable cleat 500 can be seen entering through-hole 612 and cleat receptacle 614. In FIG. 7 removable cleat 500 has entered through-hole 612, and fastener portion 502 has engaged cleat receptacle 614. The removable cleat 500 may be screwed into the hole until the completion of the insertion process. Upon fastening, base 506 of head 504 is flush against the outer horizontal surface of a flange 600.

In some embodiments, one or more cleat receptacles may include corresponding threading that engages with the threading disposed along fastener portion 502. This may permit removable cleat 500 to be screwed into plate segment 610. In some embodiments, there may be other mechanisms by which fastener portion 502 engages with the hole to attach removable cleat 500 to plate segment 610.

In some embodiments, the inner wall of through-hole 612 may be relatively smooth. In other embodiments, the inner wall of the through-hole 612 may be ridged or grooved in some way. In some embodiments, through-hole's 612 inner surface may not include a corresponding threaded portion. In other embodiments, the inner surface of the through-holes may have threading within.

In different embodiments, a through-hole 612 of first chassis 102 and corresponding cleat receptacle 614 may differ in diameter. In some embodiments, through-hole 612 can be wider than the opening of cleat receptacle 614. In other embodiments, the diameter D2 of through-hole 612 and the diameter D1 of cleat receptacle 614 may be the same. In the embodiment of FIGS. 6 and 7, through-hole 612 can be seen as having a larger diameter D2 than the diameter D1 of cleat receptacle 614.

In one embodiment there may be a portion of plate 106 disposed around the cleat receptacle, on the surface of knob 602. This portion may comprise an annulus shape, and may be referred to as knob annulus 608. In some embodiments, due to the difference in between diameter D1 and diameter D2, a void 606 may form between base 506 of removable cleat 500 and knob annulus 608. In some embodiments, as removable cleat 500 is inserted into the through-hole of flange 600, void 606 may be disposed around fastener portion 502. In some embodiments, upon fastening, a relatively small portion of fastener portion 502 may be enclosed within the cylindrical void 606.

In some embodiments, once fastener portion 502 is screwed into the hole and fully fastened, void 606 may have a cylindrical shape. The cylindrical void 606 may be flanked on one end by base 506 of threaded cleat head 504 and flanked on the other end by the surface of plate segment 610. In some embodiments, the surface of plate segment 610 that flanks one end of void 606 may be the surface of knob 602 that may be disposed around the cleat receptacle. This may be knob annulus 608. The curved outer boundary of void 606 may be comprised of the round inner wall of the through-hole.

In different embodiments, first chassis 102 may be attached to article of footwear 104 using a system of removable cleats. In some embodiments, the pressure of the removable cleat head 504 upon the outer surface of flange 600 can provide a force similar to that of a vise. This force may help to attach the chassis to article of footwear 104. In some embodiments, base 506 rests against the outer surface of flange 600, and the two surfaces may be pressed flush together when removable cleat 500 is fully threaded and inserted into cleat receptacle.

In different embodiments, the contours of knob 602 and the contours of flange 600 may be substantially similar, or they may differ. In some embodiments, the overall outer shape of knob 602 may be substantially similar to the overall shape of flange 600. In some embodiments, the shape of knob 602 may be relatively smaller than the shape of flange 600. In other embodiments, flange 600 may be only large enough to enclose knob 602 when first chassis 102 is attached to plate segment 610. In one embodiment, knob 602 may fit snugly underneath flange 600 when first chassis 102 and plate segment 610 are attached.

The embodiment of FIG. 8 illustrates a cross-section from an article of footwear 104. In this figure, fourth through-hole 130 is depicted as just large enough so that fastener portion 502 can be inserted, but small enough so that removable cleat head 504 cannot be inserted through fourth through-hole 130. As removable cleat 500 is fastened to plate segment 610, removable cleat head 504 imposes a force on the outer face of the chassis along flange 600. The compressive force applied to flange 600 by the removable cleat head 504 secures a region of the chassis in place with plate 106. In some embodiments, head 504 of removable cleat 500 may be flush against the surface of flange 600.

In other embodiments, the shape, length, depth, width, and circumference of fastener portion 502 and the inner threading of the cleat receptacle hole may vary. The cross-sections in FIGS. 6, 7 and 8 are for illustrative purposes only and depict only one embodiment of a fastening mechanism.

Figure 9:
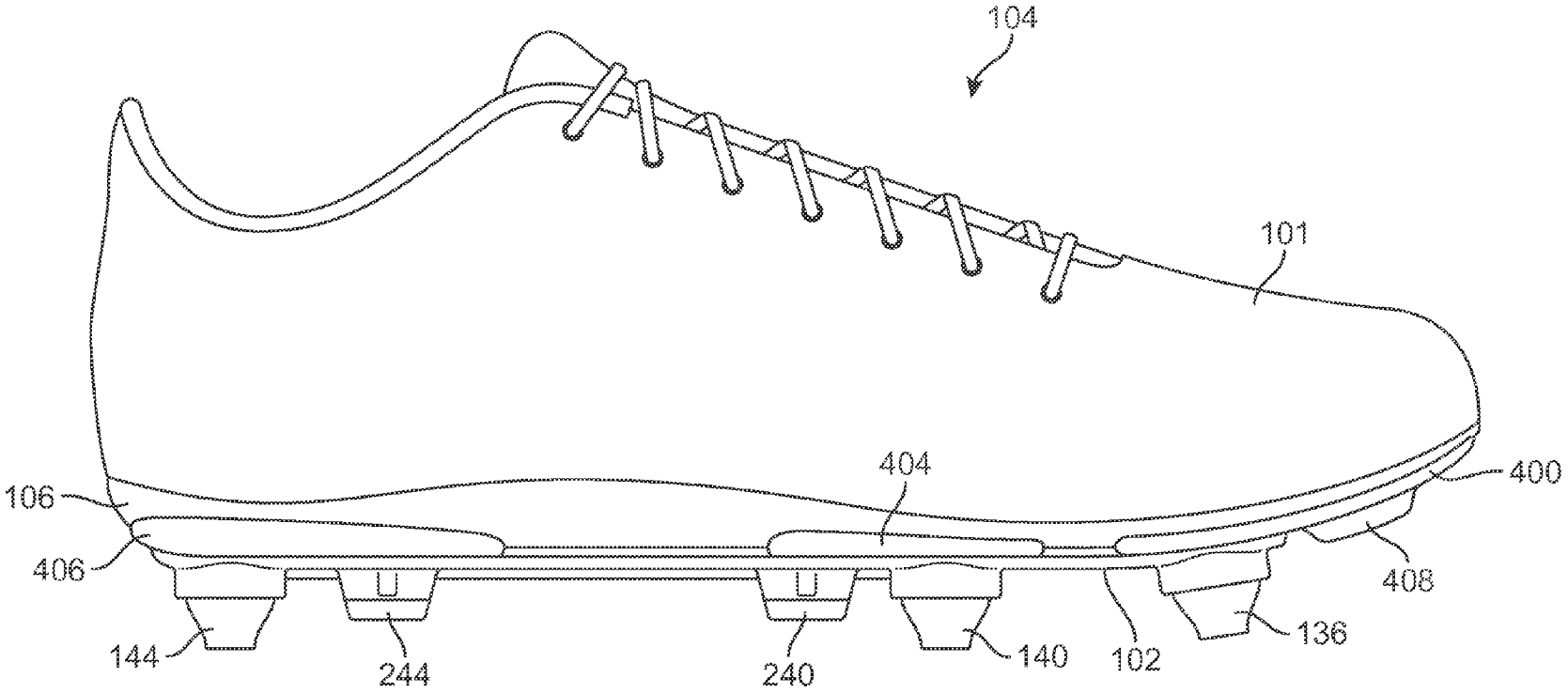
FIG. 9 is a side view of an embodiment of an article of footwear.

FIG. 9 is a side view of an embodiment of article of footwear 104. Article of footwear 104 includes an upper 101. Upper 101 may be constructed of any material. In some embodiments, upper 101 may be constructed of leather and/or synthetic materials. In some embodiments, upper 101 may be constructed of many different materials.

Article of footwear 104 further includes plate 106 attached to article of footwear 104. In some embodiments, plate 106 may be comprised of a plurality of segments. In one embodiment three plate segments may be seen.

In the illustration, first chassis 102 is attached to the underside of article of footwear 104. First chassis 102 is depicted as removably attached to plate segments. First chassis 102 includes a first fixed cleat set 238 with bladed fixed cleats. First bladed fixed cleat 240 and third bladed fixed cleat 244 can be seen in this figure. In one embodiment, three removable cleats are also depicted.

In different embodiments, the outer surface of the chassis may include a generally matching contour with the inner surface of article of footwear 104. In other embodiments, the outer surface of the chassis may comprise a generally matching contour with the inner surface of plate 106.

Figure 10:
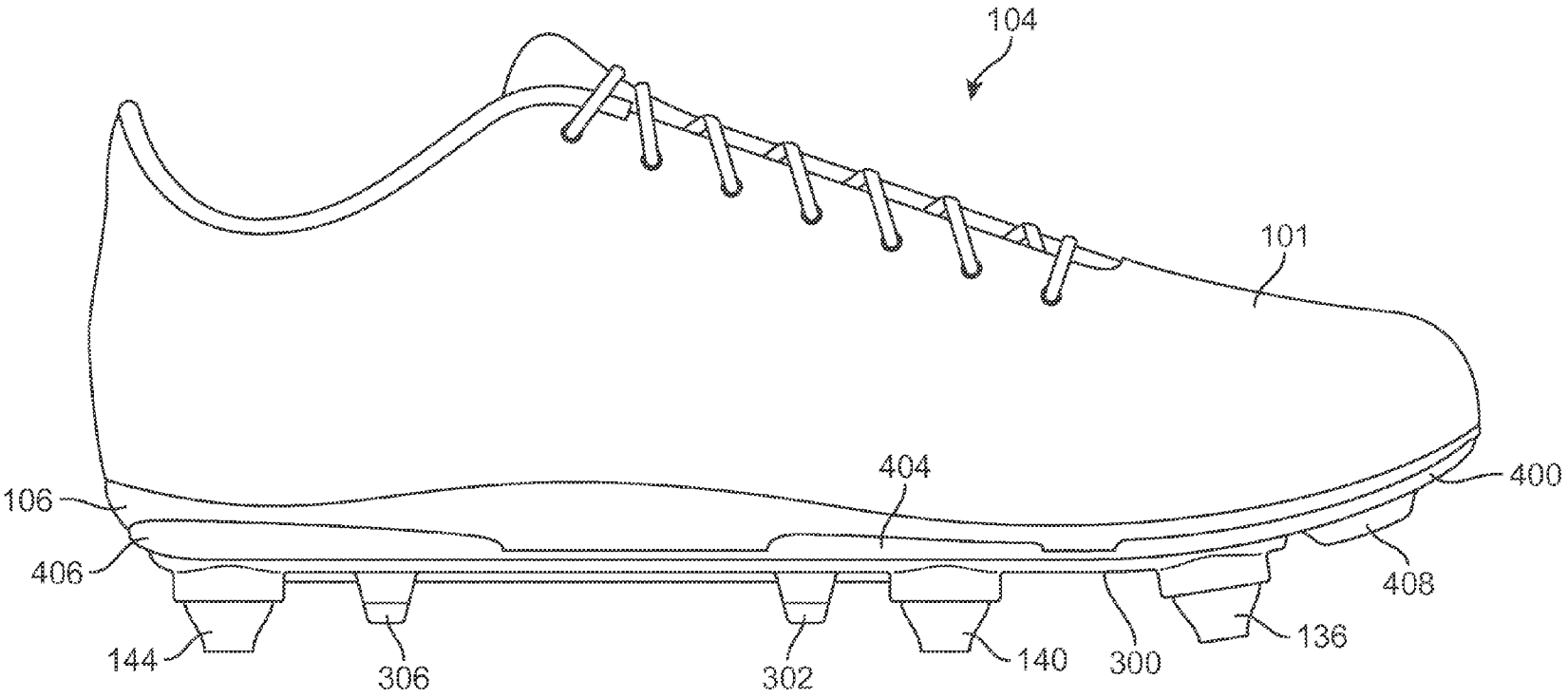
FIG. 10 is a side view of an embodiment of an article of footwear.

Referring to FIG. 10, a side view of an article of footwear 104 is presented. As described in FIG. 9, article of footwear 104 includes an upper 101, and upper 101 may further include plate 106 attached to article of footwear 104. In one embodiment, three plate segments are depicted. In this illustration, second chassis 300 is attached to the underside of article of footwear 104. Second chassis 300 is shown as removably attached to plate segments. Second chassis 300 includes a second fixed cleat set 310 with round fixed cleats. First round fixed cleat 302 and third round fixed cleat 306 can be seen in this figure. In one embodiment, three removable cleats are also depicted.

Generally, different types of cleats may be preferred for different playing grounds and player needs. For example, bladed fixed cleats as seen in FIG. 9 may be beneficial for offensive actions as they permit sharp turns with less slip. Bladed cleats can also enhance the ability to pivot. Round fixed cleats as illustrated in FIG. 10 may be better suited for defensive actions as they can provide greater stability in play.

Bladed fixed cleats may provide improved contact and grip with surfaces like firm grass, or artificial turf. Play in drier conditions, such as hard grass lots in a dry season or dry turf, may encourage the choice of bladed cleats. Round cleats may provide better grip and traction in soft ground environments, including but not limited to wet or muddy fields. Round cleats can in some embodiments, help minimize slipping in wet conditions.

Figure 11:
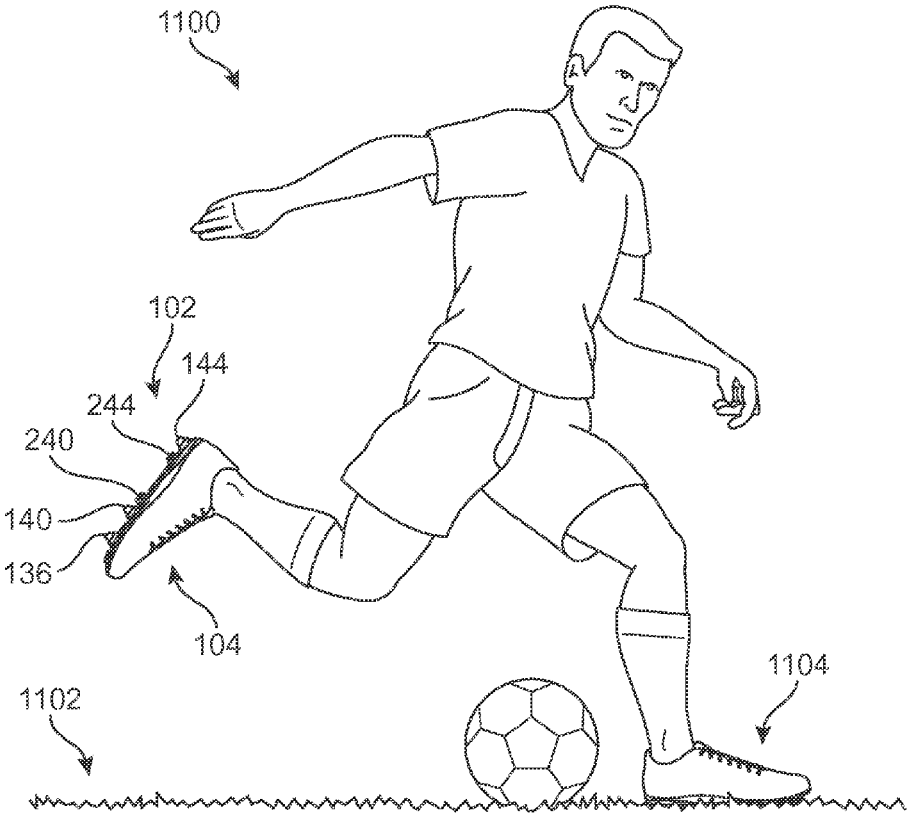
FIG. 11 is a view of a user wearing an embodiment of an article of footwear.

In FIG. 11, a user 1100 is shown wearing an embodiment of article of footwear 104 with a chassis system 100. In different embodiments, a user 1100 can wear complementary articles of footwear. In one embodiment, user 1100 is wearing complementary article of footwear 1104, which is complementary to article of footwear 104 and may include a similar chassis system.

Article of footwear 104 shown in this figure is attached to a first chassis 102. In this illustration, first chassis 102 includes a first fixed cleat set 238 with bladed fixed cleats. First bladed fixed cleat 240 and third bladed fixed cleat 244 can be seen on the right foot in this figure. In one embodiment, three removable cleats are also depicted. Article of footwear 1104 also has a corresponding chassis with bladed cleats. The left foot is shown in contact with the surface 1102. In some embodiments, the fixed cleats and removable cleats on the left foot may be concealed by the uneven surface contours of the surface 1102. The fixed cleats and removable cleats may also hidden by the extent of their insertion into the surface 1102. As the surface 1102 is relatively firm and dry, user 1100 has opted for first chassis 102, which may provide improved traction.

Figure 12:
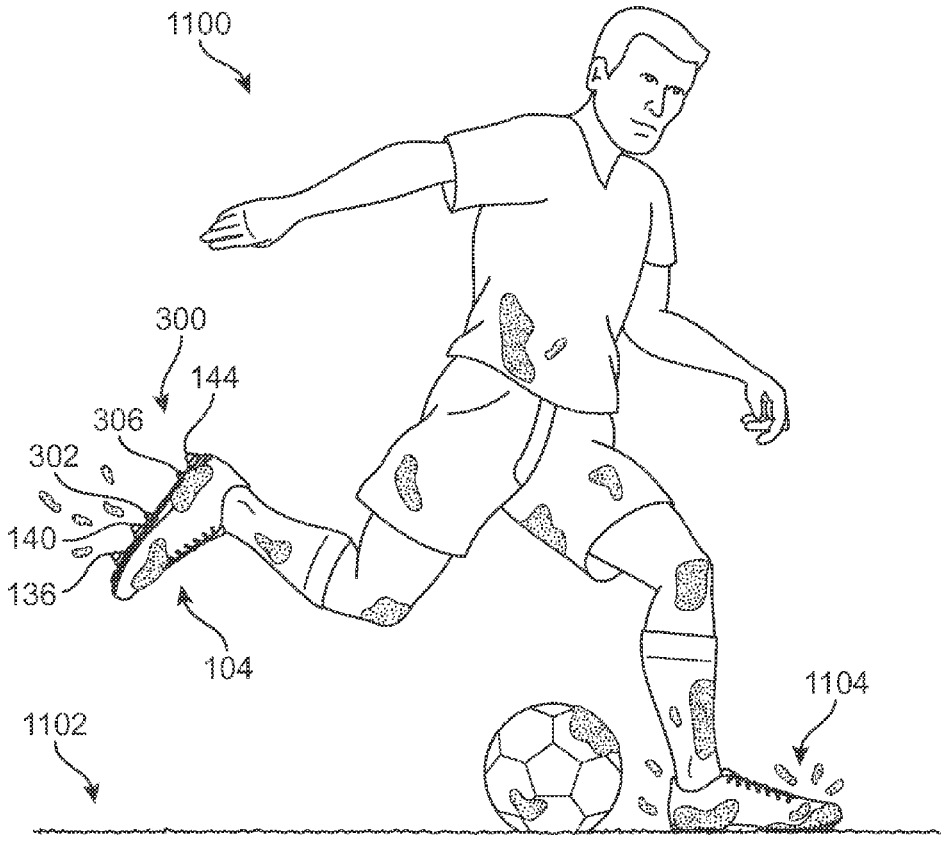
FIG. 12 is a view of a user wearing an embodiment of an article of footwear.

Referring to FIG. 12, user 1100 is shown wearing an embodiment of article of footwear 104 with a chassis system 100. As described earlier, in different embodiments, user 1100 can wear complementary articles of footwear including article of footwear 104 and article of footwear 1104. In this illustration, user 1100 is wearing complementary articles of footwear with complementary chassis systems 100 for a left foot and for a right foot.

Article of footwear 104 shown in this figure are each attached to a second chassis 300. In this representation, second chassis 300 includes a second cleat set 310 with round fixed cleats. First round fixed cleat 302 and third round fixed cleat 306 can be seen on the right foot in this figure. In one embodiment, three removable cleats are also depicted. The left foot is shown in contact with the surface 1102. In some embodiments, the fixed cleats and removable cleats on the left foot may be hidden by the uneven surface contours of the surface 1102. They can also be hidden by the extent of the cleats' insertion into the surface 1102. As the surface 1102 is relatively muddy and slippery, user 1100 has opted for second chassis 300, which may provide increased traction.

It should be noted that complementary articles of footwear may include different chassis and/or cleat configurations. For example, a complementary chassis for a right foot may include three members disposed in chassis forefoot region 110 while the complementary chassis for a left foot may include two cross-members disposed in forefoot region 110. In addition, a chassis may include different cleat or tread element configurations for a complementary pair of footwear. For example, a complementary article of footwear 104 for a right foot may include one or more fixed cleats disposed along the forefoot 110 and/or heel regions 114, while article of footwear 1104 for a left foot may include one or more fixed cleats disposed only along the midfoot region 112. In other embodiments, a matching pair of articles may have fixed cleats disposed on opposing sides. In other embodiments, an article for a left foot may have one or more fixed cleats disposed only on lateral side 118, while a matching article for a right foot may have one or more fixed cleats additionally disposed on medial side 116. In other embodiments, complementary articles of footwear may have the same arrangement of one or more fixed cleats on both articles. In still other embodiments, complementary articles of footwear may have the same arrangement of one or more fixed cleats in one region and have opposing arrangements of one or more fixed cleats in another region.

It should be noted that the articles of footwear in the figures provided in the specification are shown generically only for the purpose of illustration. In other embodiments, the articles of footwear may be different styles and colors.

Figure 13:
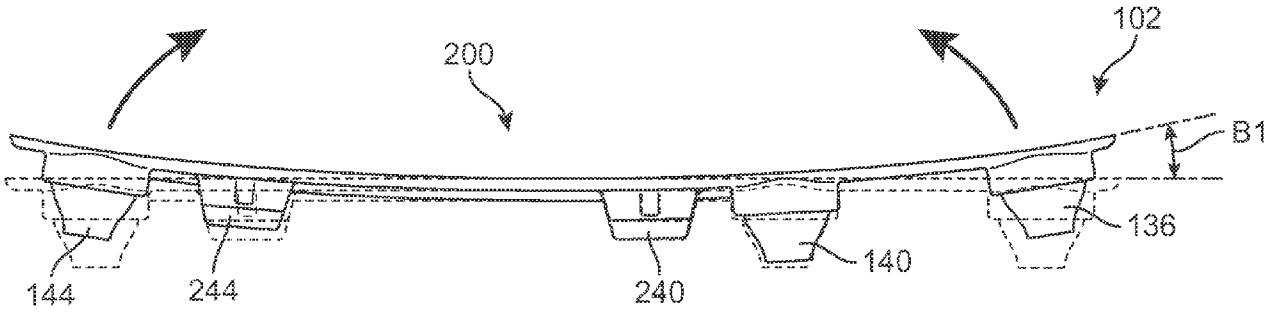
FIG. 13 is an side view of an embodiment of a first chassis.
Figure 14:
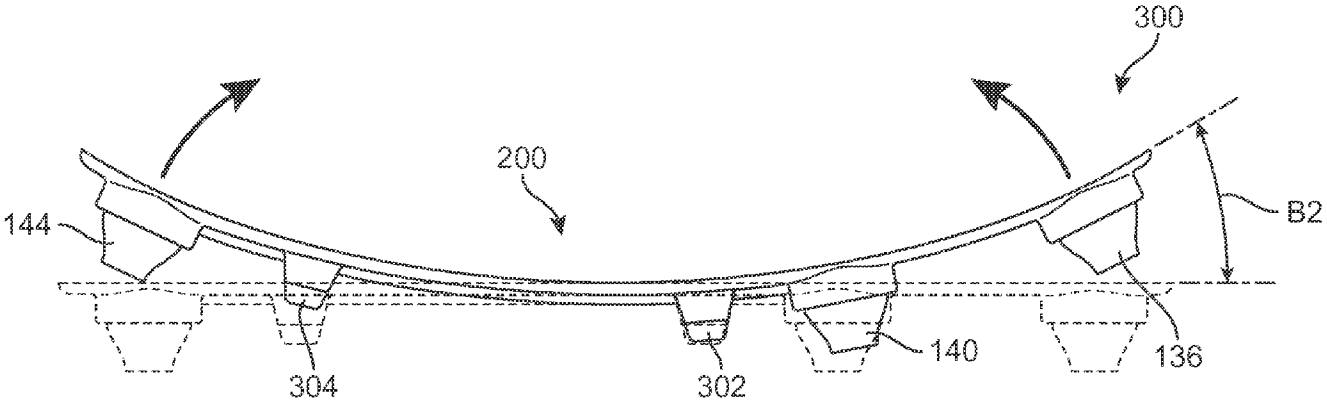
FIG. 14 is an side view of an embodiment of a second chassis.

The chassis may include a structure that can enhance performance of an article of footwear. A chassis may comprise structural provisions to support and permit differing degrees of flexibility to an article of footwear 104. FIGS. 13 and 14 illustrate side views of embodiments of the chassis as a force is imposed on the chassis.

In different embodiments, the structural properties of a first chassis 102 could be the same or substantially similar as the structural properties of second chassis 300. In other embodiments, the structural properties of first chassis 102 could vary as compared to the structural properties of second chassis 300. In some embodiments, each chassis may be associated with different rigidities. In an exemplary embodiment illustrated in FIG. 13, a first chassis 102 may be associated with a first rigidity. In FIG. 14 a second chassis 300 can be seen that may be associated with a second rigidity. In some embodiments, one chassis may be associated with a rigidity substantially greater than the rigidity of another chassis. In other embodiments, different portions of a chassis structure may be associated with various rigidities. In some embodiments, the chassis structure may comprise portions of substantially similar rigidities.

In FIG. 13 a side view of an embodiment of first chassis 102 is shown. First chassis 102 may be comprised of a material with a first rigidity. FIG. 13 depicts first chassis 102 as it would be at rest, with little or no forces acting on it, in a dotted line representation. In the same figure, overlaid on the dotted line representation, first chassis 102 is shown as it is being bent. The curved upward arrows on both sides of first chassis 102 represent the force being applied on first chassis 102. The extent of bending that occurs by first chassis 102 as a result of the force is represented by B1. With a material that has a greater rigidity, the bending that occurs may be relatively limited.

In FIG. 14, a side view of an embodiment of a second chassis 300 is illustrated. Second chassis 300 may be comprised of a material with a second rigidity. The second rigidity may be less than the first rigidity. Referring to FIG. 14, second chassis 300 is shown as it would be at rest, with little or no forces acting upon it, in a dotted line representation. In the same figure, overlaid on the dotted line representation, second chassis 300 is shown as it is being bent. The curved upward arrows on both sides of second chassis 300 represent the force being applied on second chassis 300. The extent of bending that occurs by second chassis 300 as a result of the force is represented by B2. The forces being applied to second chassis 300 are depicted as equivalent to the forces that were depicted acting on first chassis 102 in FIG. 13. Comprised of material with lesser rigidity, second chassis 300 may undergo greater bending B2 than the bending B1 of first chassis 102. In one embodiment, bending B1 is less than bending B2. In other embodiments, bending B1 and bending B2 may be substantially similar. In other embodiments, bending B1 may be greater than bending B2.

A chassis with less rigidity may bend to a greater extent than another chassis with high rigidity, when subjected to substantially same forces. A choice between a chassis with relatively high rigidity and a chassis with relatively low rigidity may permit a use to better adapt article of footwear 104 to the user's needs. Factors such as lateral stability, agility, comfort, speed, balance, weight and other factors may inform the preferences of user 1100 in selecting a chassis of a particular level of rigidity.

The differing rigidities of each chassis structure may be achieved in various ways. As an example, in an exemplary embodiment first chassis 102 structure may comprise a first material and second chassis 300 structure may comprise a second material. In this embodiment, first chassis 102 material and second chassis 300 material may be substantially different materials having substantially different rigidities. In particular, first chassis 102 material may be made of a semi-rigid material, including, but not limited to rubber, hard foam, and other deformable materials. In addition, second chassis 300 material may be a substantially rigid material, including, but not limited to plastics, polymers, nylon, polyurethane, and other rigid materials. However, it will be understood that any other materials with increasing levels of hardness could be used. In still other embodiments, it may be possible to modify the rigidity of one or more portions of the chassis structure by varying the geometry and/or thickness of the chassis materials.

By varying the rigidity of each chassis structure, each chassis may deform by a substantially different amount upon contact with a surface 1102. This arrangement allows each chassis structure to be tuned for maximizing traction with a particular type of ground or surface 1102. In some embodiments, user 1100 may select a chassis based on the need for a specific level of rigidity and structure that is optimal for a particular type of surface 1102. The variations in rigidity available for each chassis may permit user 1100 to select according to preference. The selected chassis may provide a better grip to a particular surface 1102.

It should be noted that either first chassis 102 or second chassis 300 may be provided with varying rigidities. In some embodiments, a first chassis 102 may include a material with a relatively low rigidity that is optimized for maximizing traction with a firm or artificial turf surface. In another embodiment, a second chassis 300 may include a material with a relatively high rigidity that is optimized for maximizing traction with soft natural grass. In another embodiment, a third chassis may have an intermediate rigidity that is optimized for maximizing traction with dry or firm natural grass. In addition, other embodiments can include further configurations of chassis materials and comprise varying levels of rigidity.

It is important to note that a chassis associated with one level of rigidity may include any type or combination of fixed and/or removable cleats. Though the depictions of FIGS. 13 and 14 represent first chassis 102 and second chassis 300 as attached to particular cleat types, these figures are for illustrative purposes only. The figures should not be understood to limit the disclosure in any way. For example, in FIG. 13, first chassis 102 with relatively less rigidity includes first fixed cleat set 238 comprising bladed fixed cleats. In FIG. 14, second chassis 300 with relatively high rigidity includes second fixed cleat set 310 comprising round fixed cleats. However, in different embodiments a fixed cleat set of a chassis comprising relatively low rigidity may be round, bladed, or any other shape. The fixed cleat set for chassis with relatively low rigidity may vary in geometry, height, diameter, rigidity or may have other distinct characteristics. In other embodiments, the fixed cleat set of a chassis comprising relatively high rigidity may be round, bladed, or any other shape. A fixed cleat set for chassis with relatively high rigidity may vary in geometry, height, diameter, rigidity or may differ in other characteristics. It should be noted that these variations in features and characteristics may also be applied to the removable cleat set 108 that is associated with the selected chassis. In other words, a chassis may have one level of rigidity and be associated with a variety of fixed cleats and/or removable cleats.

The type of cleats, tread elements, and chassis flexibility to be applied to an article of footwear 104 may be chosen on the basis of several factors. First, knowing the surface on which footwear will be used is of primary importance in determining the type of cleats, tread elements, and chassis rigidity to be selected. Furthermore, it may be important to know the conditions of the surface. In this way, an article of footwear 104 may be configured to maximize performance for a specific type of surface and a specific set of surface conditions. Different surfaces may require the use of different types of cleats, tread elements, and rigidity. Similarly, different surface conditions may require the use of different types of cleats, tread elements, and rigidity. Additional factors may include the weight of the user, the desired comfort level, the typical speed of the user, the position of the sport they play, as well as the style of play of the user, and other factors. For example, depending on the characteristics of a user in play, and/or their type of movement on a field, the user may prefer greater grip of the surface as they play.

Figure 15:
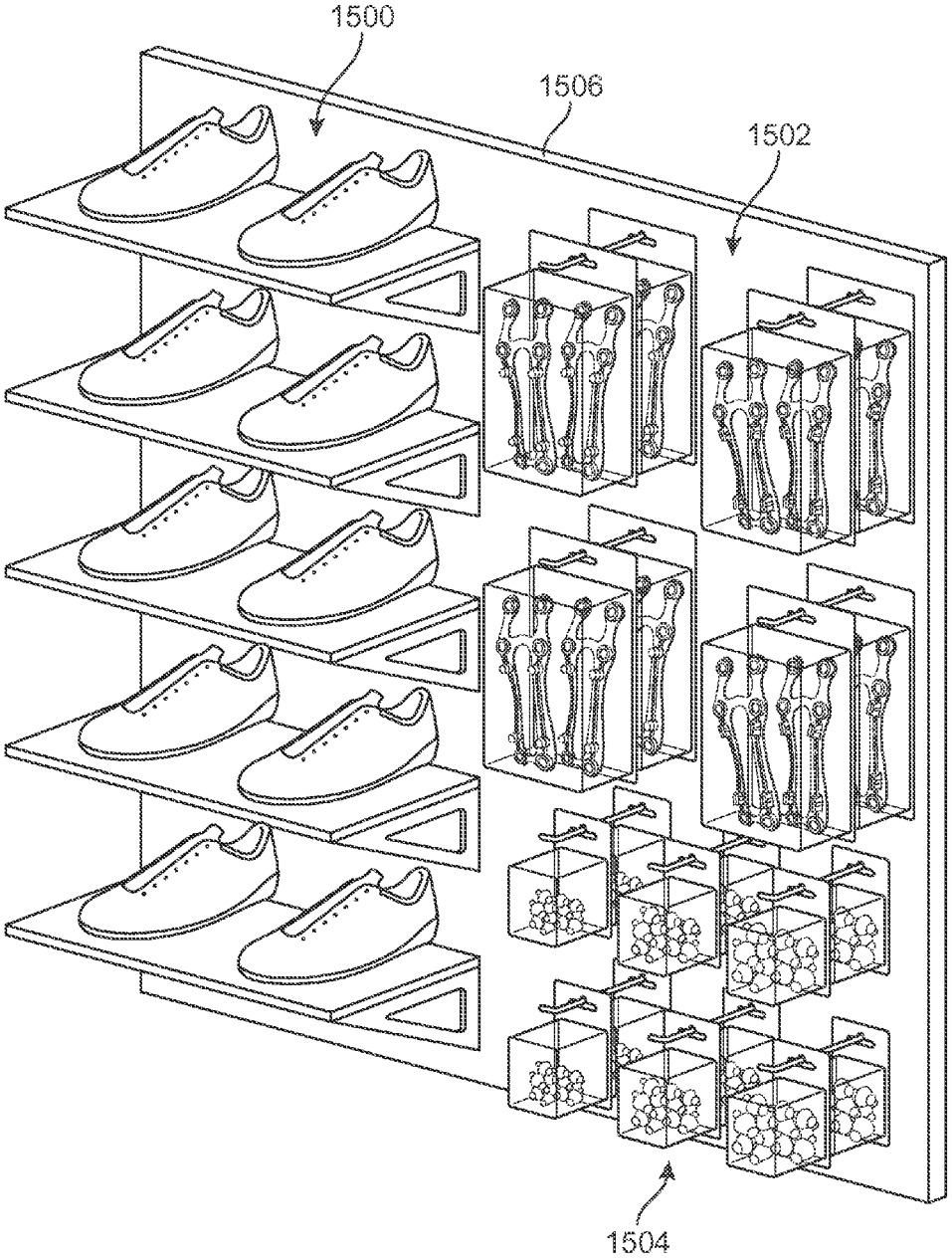
FIG. 15 is an isometric view of an embodiment of a retail system.

FIG. 15 shows an embodiment of a retail system. In one embodiment, articles of footwear 1500 are sold simultaneously with complementary pre-packaged chassis pairs 1502, and pre-packaged removable cleat sets 1504. In this figure, the retail system is shown as part of a wall 1506. In different embodiments, this wall 1506 would be a portion of a retail store or other sale place for merchandise. In other embodiments of a retail system there may be no wall 1506. The articles of footwear 1500 are shown generically in FIG. 15 only for the purpose of illustration. In some embodiments, the articles of footwear 1500 may be different styles and colors. Each pre-packaged chassis pair 1502 includes two chassis that are substantially similar, except one chassis is oriented for a left foot and the other is oriented for a right foot.

In different embodiments, using a retail system, a user could purchase an article of footwear 1500, select a pair of chassis from the group of pre-packaged chassis pairs 1502 that have been pre-packaged, and select a removable cleat set from a group of candidate removable cleat sets 1504 that have been pre-packaged. By associating a chassis of selected pre-packaged chassis pair 1502 with plate 106, and attaching that chassis by using removable cleats from pre-packaged removable cleat set 1504, the user may modify article of footwear 1500 themselves, to provide varying degrees of traction and/or flexibility.

In some situations, it may be preferable for a user to purchase multiple pre-packaged chassis pair 1502 and pre-packaged removable cleat set 1504 at one time. Using a retail system like the one illustrated in FIG. 15, a user could purchase an article of footwear 1500, three different pairs of pre-packaged chassis pair 1502, and three different sets of pre-packaged removable cleat set 1504. This would permit up to nine different variations in the type of traction and/or flexibility that could be obtained through the modifications of plate 106. In another example, a user could purchase articles of footwear 1500, four different pairs of pre-packaged chassis pairs 1502, and three of the same sets of pre-packaged removable cleat set 1504. This would permit four different variations in the type of traction and/or flexibility that could be obtained through modifications of plate 106.

Additionally, pre-packaged removable cleat sets 1504 and pre-packaged chassis pairs 1502 can be easily portable in the sense that they are small compared to the size of the articles of footwear 1500, which are already transported by the user. This feature may allow the user to modify plate 106 of article of footwear 1500 at any time and at various locations and/or events.

FIGS. 16-20 illustrate an isometric view of a kit of parts ("kit"). In some embodiments, kit may comprise at least one footwear pair 1622, accessories for footwear pair 1622, and/or a container 1600 for storing the articles of footwear. In other embodiments, kit could include any other provisions not discussed below including but not limited to: instructions, various kinds of media (such as CDs, DVDs, etc.), additional storage containers for storing footwear pairs 1622 and/or article accessories as well as any other provisions. Generally, footwear pair 1622 associated with the kit may be any type of footwear.

Kit may be offered for sale at a retail location, as discussed previously. Kit may also be offered for sale at a kiosk, factory outlet, manufacturing store, and/or through an online vendor. In some embodiments, the various parts of kit are sold together. In other embodiments, some parts of kit may be sold separately. As an example, the current embodiment of FIG. 16-20 depicts a kit of parts including container 1600, footwear pair 1622, a first chassis candidate pair 1618, a second chassis candidate pair 1620, a first set of removable cleats 1614 and a second set of removable cleats 1616. In other embodiments, a retailer could sell a kit including footwear pair 1622, first chassis candidate pair 1618, and second set of removable cleats 1616. In other cases, a retailer could sell a kit including footwear pair 1622, first chassis candidate pair 1618, second chassis candidate pair 1620, a third chassis candidate pair, and three sets of removable cleats. The removable cleats sets may be substantially similar in some embodiments, or they may differ in some aspects. In another embodiment the retailer could sell a kit including footwear pair 1622, first chassis candidate pair 1618, and second chassis candidate pair 1620. In other embodiments, the retailer could sell one or more other pairs of chassis candidates separately from the kit. Furthermore, the retailer could sell removable cleat set 108 and/or footwear pair 1622 separately from the kit.

Kit may include container 1600. Container 1600 can be any type of container configured to store at least one footwear pair 1622. In some embodiments, container 1600 may be a box. In one embodiment, container 1600 may be a shoebox that is configured to store footwear. In some embodiments, container 1600 may have a generally rectangular shape, and can include a lower portion and a lid. In other embodiments, container 1600 could be a bag, sack, or other type of container. In other embodiments, the various items in the kit may not be provided in a container 1600.

In some embodiments, kit includes footwear pair 1622 that comprise various interchangeable components. In some embodiments, kit may include one or more pair of chassis candidates. A chassis candidate refers to a chassis that may be selected for use with one or both articles of footwear pair 1622. One chassis candidate may differ in some feature, characteristic, or aspect from another chassis candidate. In the embodiments of FIGS. 16-20, the kit includes two pairs of chassis candidates. The two pairs comprise a first chassis candidate pair 1618 and second chassis candidate pair 1620. Each chassis candidate pair includes two chassis candidates that are substantially similar, except one chassis candidate is oriented for a left foot and the other is oriented for a right foot. First chassis candidate pair 1618 includes a first chassis candidate 1606 for the left foot and a first chassis candidate 1608 for the right foot. Second chassis candidate pair 1618 includes a second chassis candidate 1610 for the left foot and a second chassis candidate 1612 for the right foot.

Figure 16:
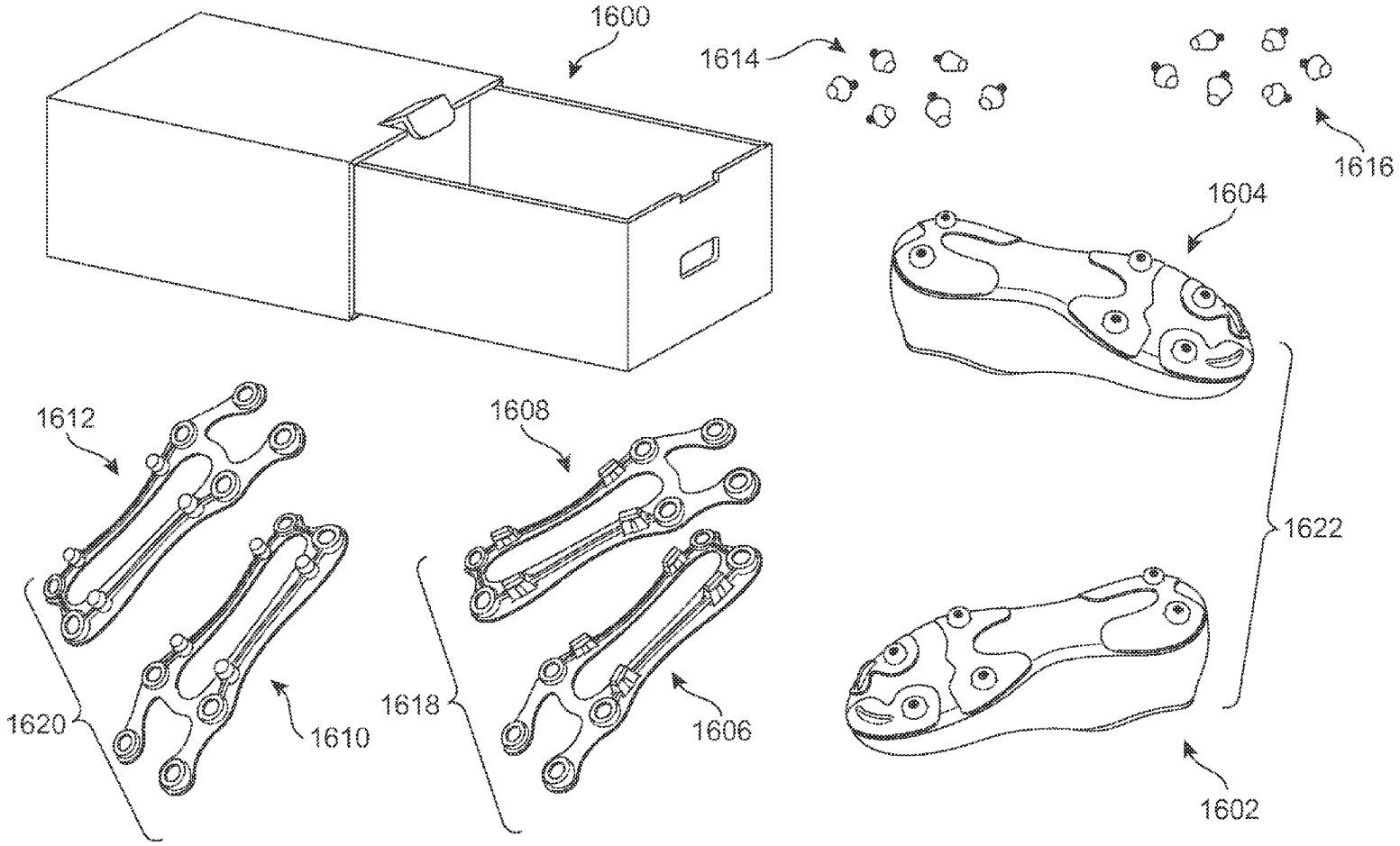
FIG. 16 is an isometric view of an embodiment of a chassis system.

FIG. 16 illustrates an isometric view of an embodiment of the kit, including a container 1600, footwear pair 1622, first chassis candidate pair 1618, second chassis candidate pair, first set of removable cleats 1614, and second set of removable cleats 1616. Each component is presented as it might appear prior to user selection or assembly. In one embodiment, user has the choice of equipping one or more articles of footwear pair 1622 with a first chassis candidate 1618 or second chassis candidate 1620.

Figure 17:
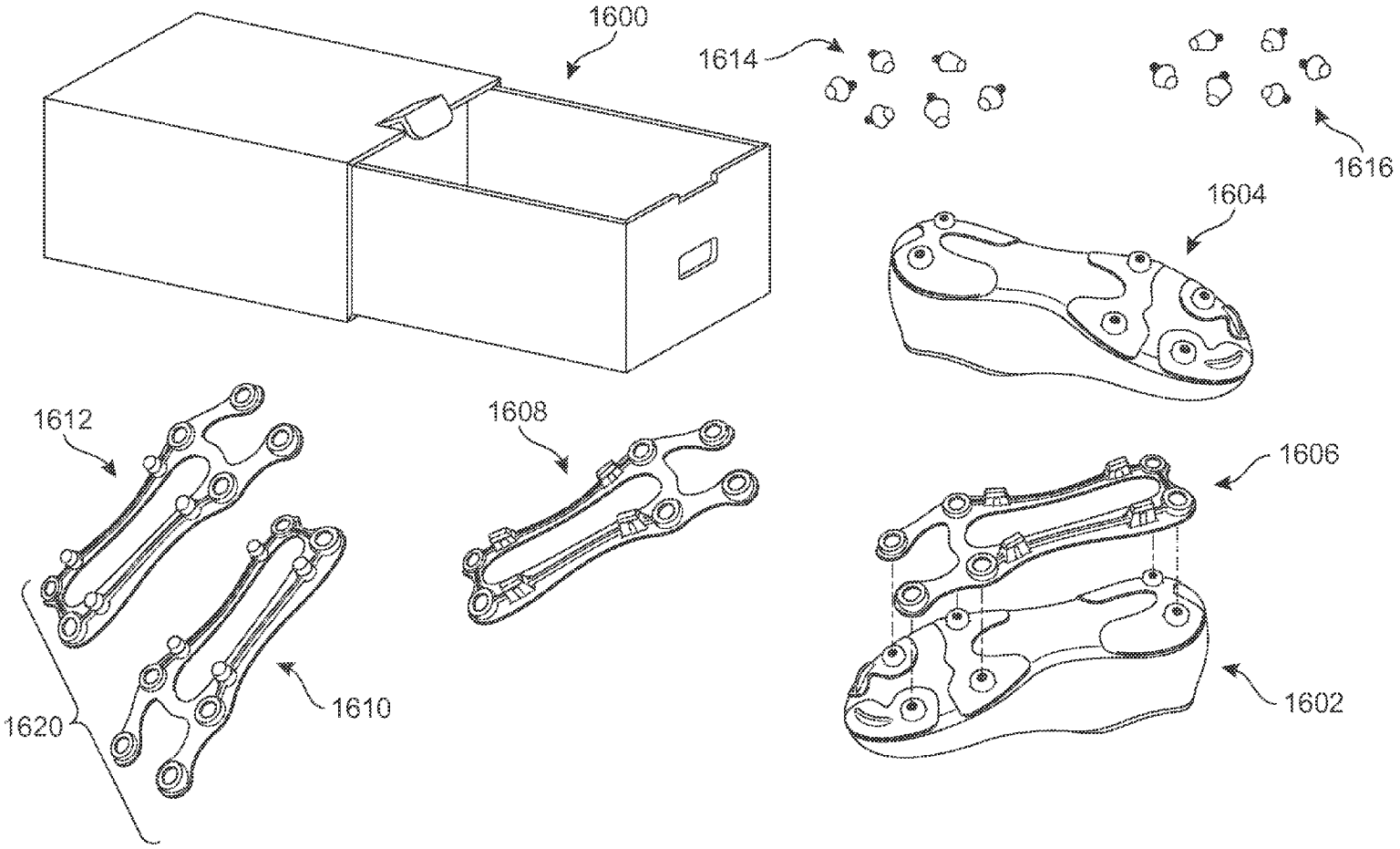
FIG. 17 is an isometric view of an embodiment of a chassis system.

FIG. 17 illustrates an isometric view of an embodiment of the kit. In this figure, user has selected an article of footwear 1602 corresponding to a left foot 1602, and a first chassis candidate 1606 for a left foot from the first chassis candidate pair 1618. First chassis candidate 1606 for a left foot selected is being aligned with the article of footwear 1602 corresponding to a left foot.

Figure 18:
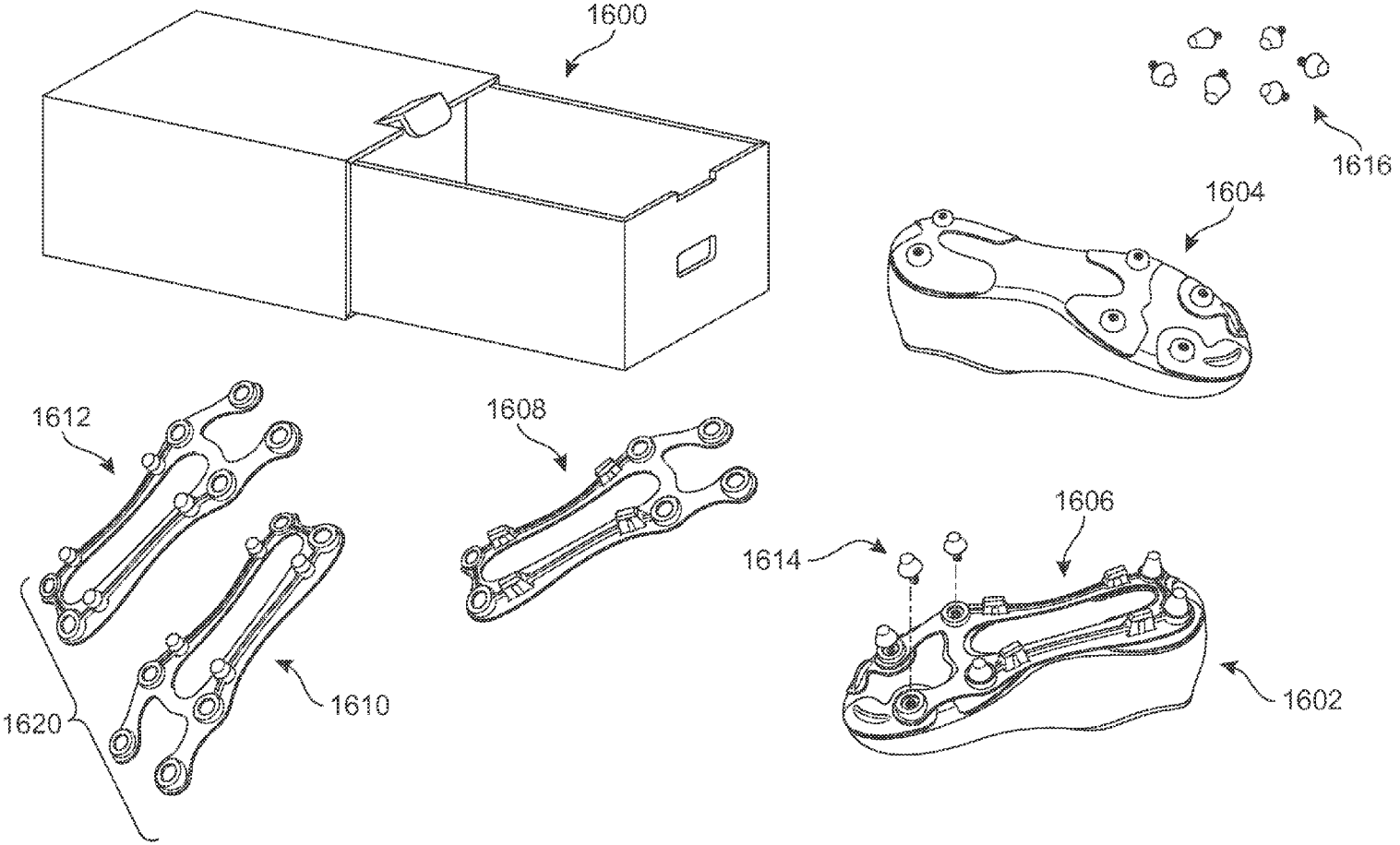
FIG. 18 is an isometric view of an embodiment of a chassis system.

FIG. 18 illustrates an isometric view of an embodiment of the kit. In this figure, user has selected first set of removable cleats 1614 from the two sets of removable cleats. The removable cleats can provide a mechanism for fastening the selected chassis candidate to plate 106 of article of footwear 1602. In one embodiment, four of the removable cleats have been inserted and engaged with first chassis candidate 1606 for a left foot 1606 and plate 106. There are two remaining removable cleats which are being inserted and screwed into first chassis candidate 1606 for a left foot and plate 106.

Figure 19:
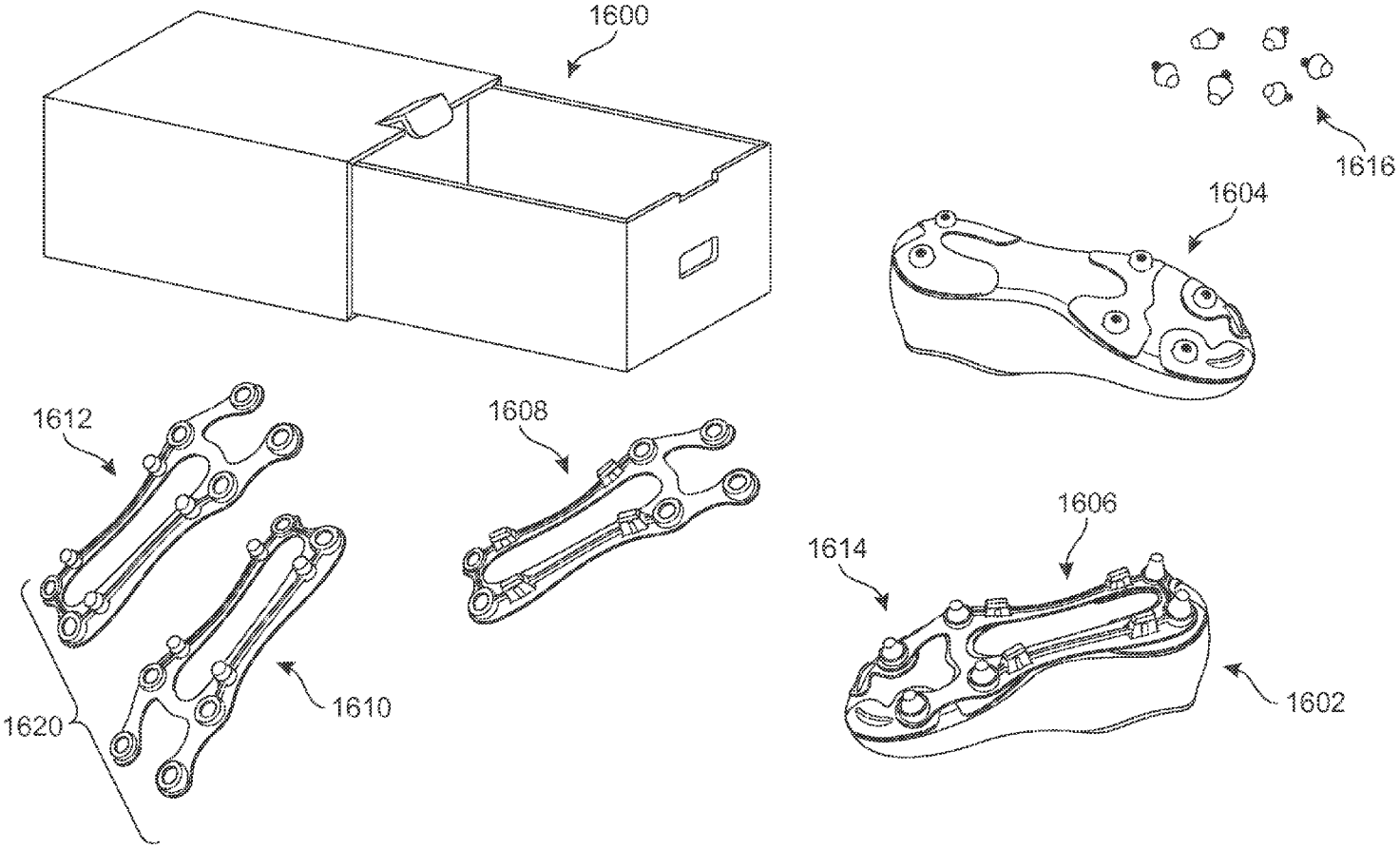
FIG. 19 is an isometric view of an embodiment of a chassis system with an assembled article of footwear.

FIG. 19 illustrates an isometric view of an embodiment of the kit. In this figure, user has completed the attachment step. First chassis candidate 1606 for a left foot has been successfully fastened to article of footwear 1602 corresponding to a left foot.

Figure 20:
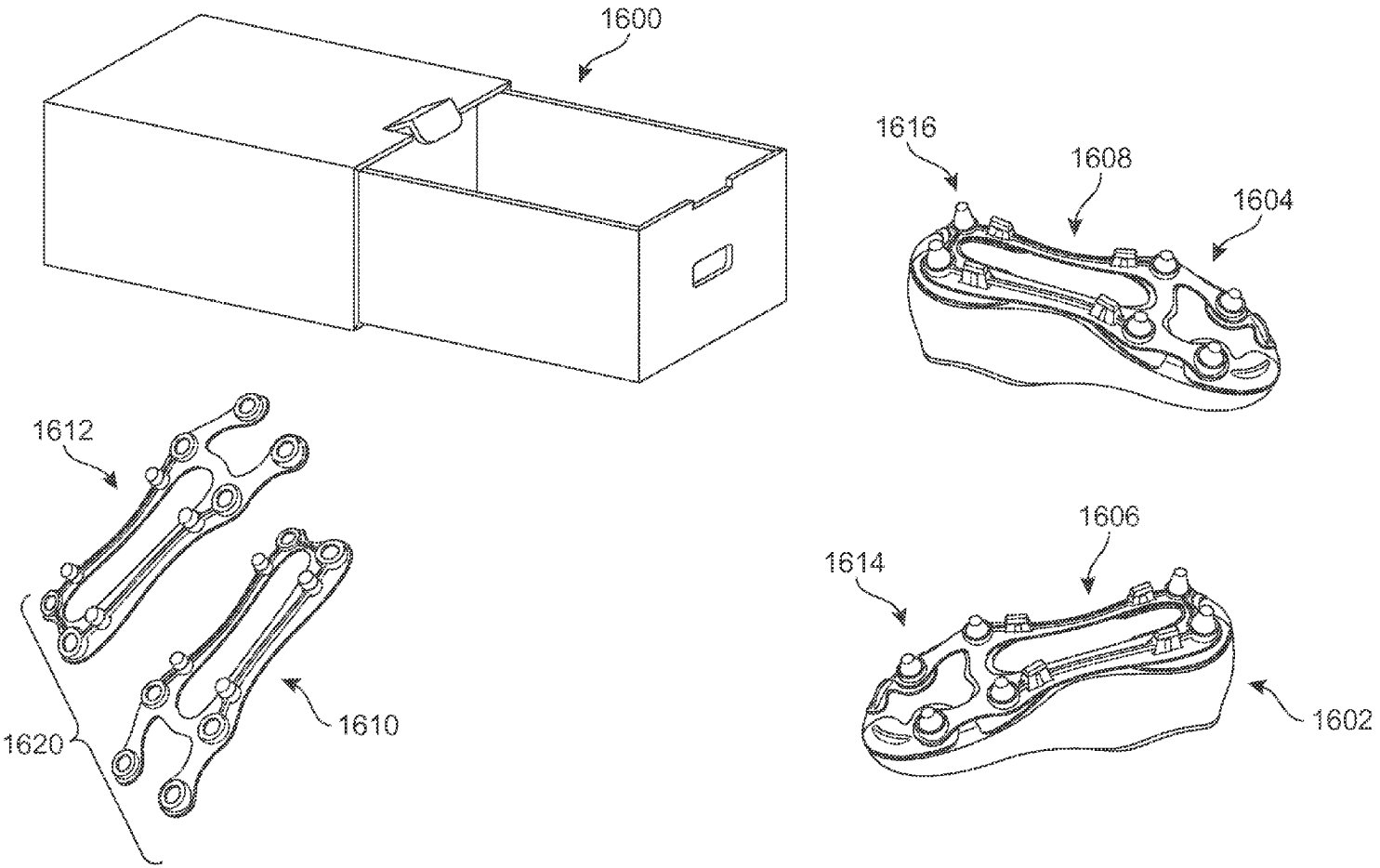
FIG. 20 is an isometric view of an embodiment of a chassis system with an assembled pair of footwear.

FIG. 20 illustrates an isometric view of an embodiment of the kit. In this figure, user has additionally completed the same series of steps for the complementary article of footwear 1604 corresponding to a right foot. First chassis candidate 1608 for a right foot has been successfully fastened to article of footwear 1604 corresponding to a right foot using second set of removable cleats 1616.

In another embodiment, user may have different needs or preferences. In other embodiments, the user may alternatively select from second chassis candidate pair for attachment to one or more articles of footwear pair 1622. The user may also select from a kit that includes a different set of removable cleats for fastening to the chassis candidate. In other embodiments, user may attach first chassis candidate 1606 for a left foot and second chassis candidate 1612 for a right foot.

Figure 21:
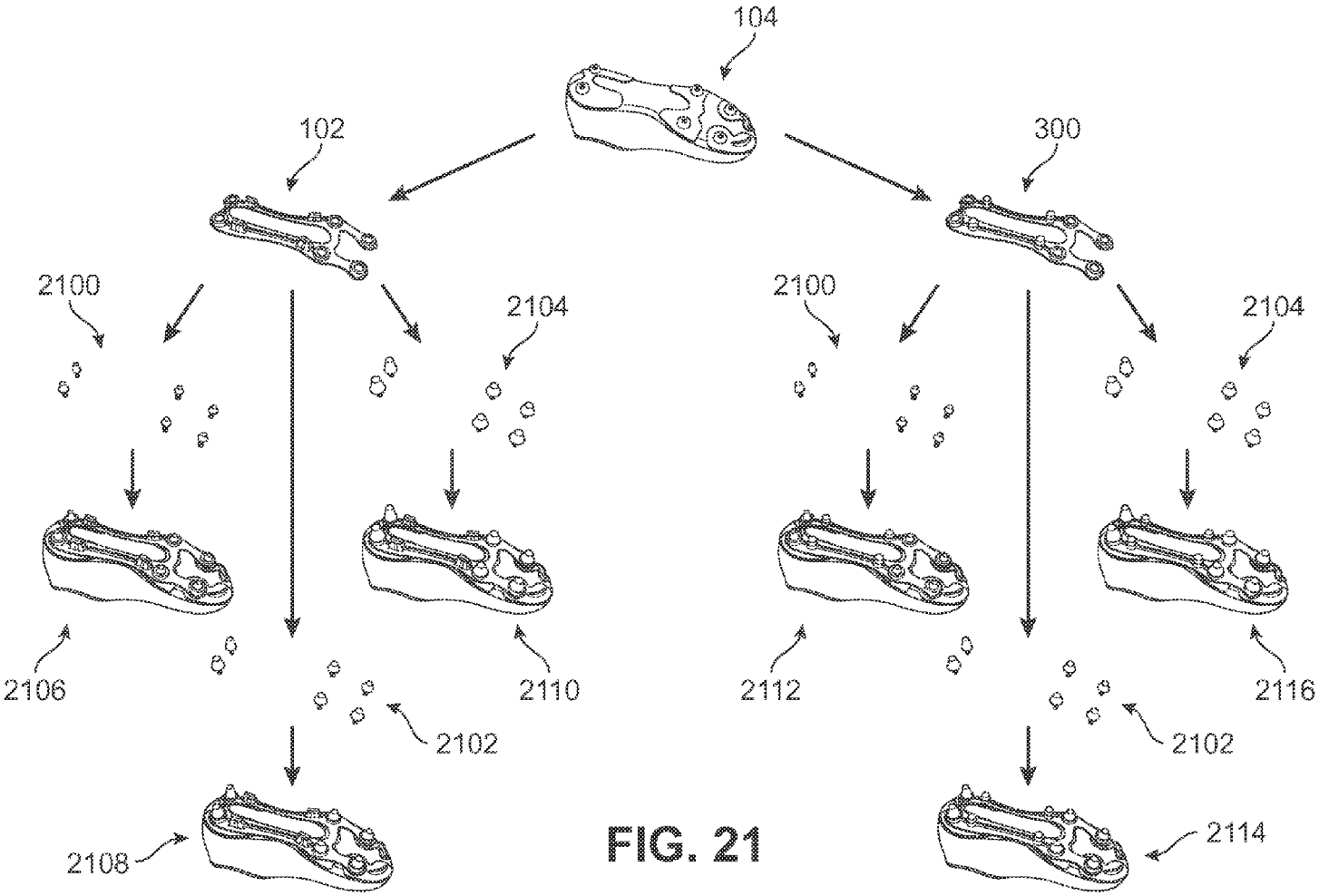
FIG. 21 is a sample representation of possible embodiments of an article of footwear.

In the next figure, several possible variations on article of footwear 104 are illustrated. FIG. 21 depicts an exemplary embodiment of article of footwear 104 that may be associated with different types of the detachable chassis and the removable cleats. In one embodiment, there is an article of footwear 104. The article of footwear 104 can be for either a left or right foot. In some embodiments, article of footwear 104 may be associated with different chassis. Two embodiments of the chassis are shown, first chassis 102 and second chassis 300. First chassis 102 includes bladed fixed cleats. Second chassis 300 includes round fixed cleats. In other embodiments, the possible chassis may differ in the fixed cleat type, material, shape, composition, and/or in other features.

In some embodiments, article of footwear 104 may be associated with different removable cleat sets. In other embodiments, removable cleats can differ in size, shape, material, weight, and/or other aspects. In the embodiment of FIG. 21, there may be three different sizes of removable cleats, comprising a small removable cleat set 2100, a medium removable cleat set 2102, and a large removable cleat set 2104.

Branching from each removable cleat set, different embodiments of the assembled article of footwear 104 are shown. In some embodiments, there is a first assembled article of footwear 2106 is associated with first chassis 102 and small removable cleat set 2100. In another example, a second assembled article of footwear 2108 may be associated with first chassis 102 and medium removable cleat set 2102. In a third embodiment, a third assembled article of footwear 2110 may be associated with first chassis 102 and large removable cleat set 2104. Similarly, a fourth assembled article of footwear 2112 may be associated with second chassis 300 and small removable cleat set 2100. Also, a fifth assembled article of footwear 2114 may be associated with second chassis 300 and medium removable cleat set 2102. In addition, a sixth assembled article of footwear 2116 may be associated with second chassis 300 and large set of removable cleats 2104.

It should be understood that these assembled articles of footwear 104 are provided as exemplary, and should not be understood to limit the disclosure in any way. The article of footwear 104, chassis, and removable cleat types depicted are examples. Many other variations of article of footwear 104 may be possible.

In some embodiments, first chassis 102 may comprise one or more open spaces in different areas of first chassis 102. In other embodiments, there may be no exposed areas. For purposes of this detailed description, spaces in first chassis 102 structure will be referred to as exposed areas. In some embodiments, when first chassis 102 is attached to article of footwear 104, these exposed areas may comprise exposed portions of the underside of article of footwear 104. In some embodiments, there may be a plurality of exposed areas. In one embodiment there are two exposed areas, comprising a first exposed area 214 and a second exposed area 248.

Figure 22:
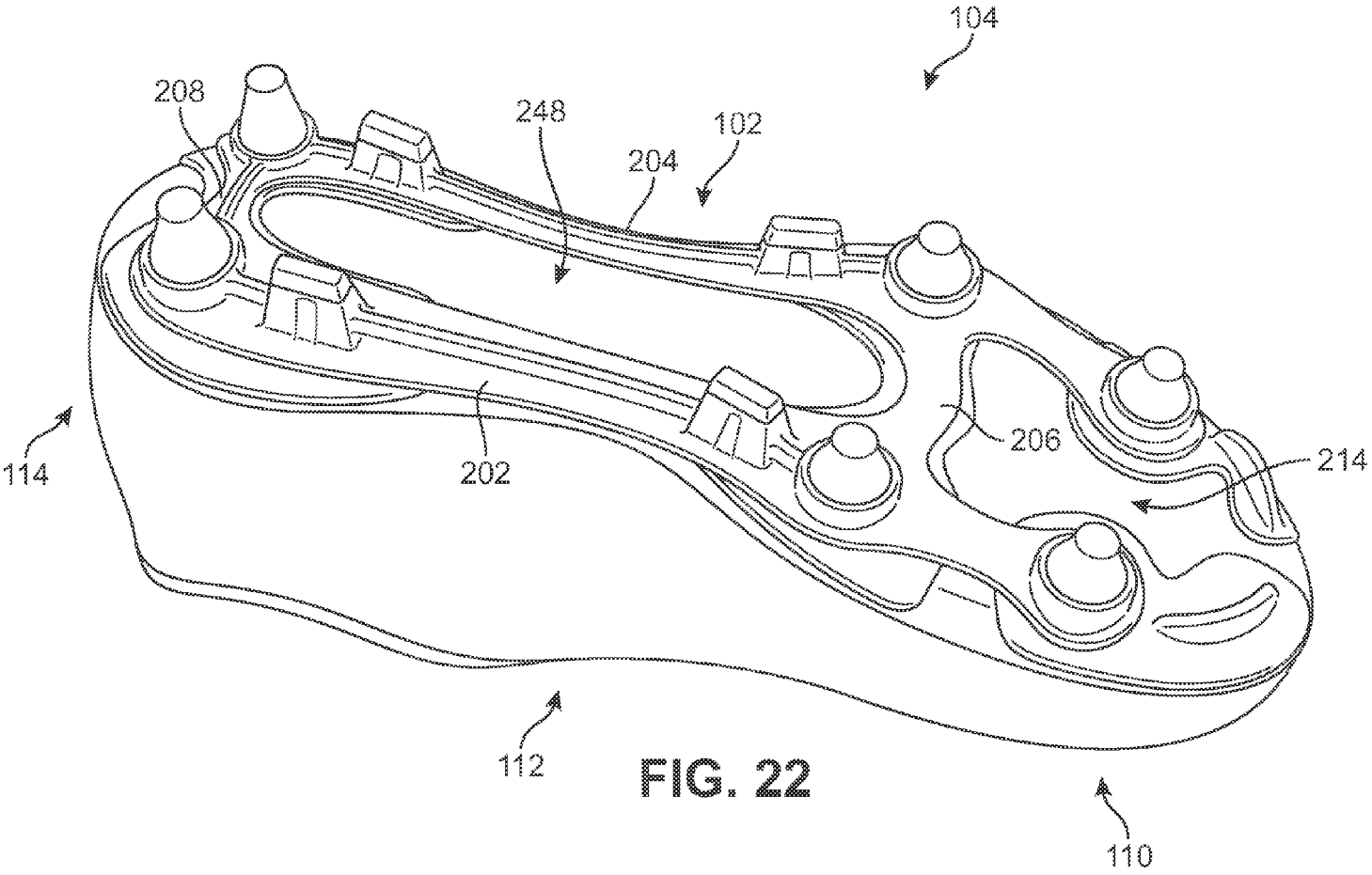
FIG. 22 is an isometric view of an embodiment of an article of footwear with a chassis system.

In different embodiments, first exposed area 214 could extend through different regions of first chassis 102. In some embodiments, for example the embodiment depicted in FIG. 22, lateral forward portion 212 and medial forward portion 210 may be disposed in such a way as to form first exposed area 214 in forefoot region 110. In some embodiments, the ends of the forward portions may rejoin first chassis 102 structure, and form a first exposed area 214 that is fully enclosed. In the embodiment shown in FIG. 22, the forward ends of lateral forward portion 212 and medial forward portion 210 do not rejoin first chassis 102. In some embodiments, each of the forward portions can extend outward, and terminate in forefoot region 110. First exposed area 214 may include a greater number of closed sides or a greater number of open sides. In some embodiments, first exposed area 214 may include a section generally enclosed on three sides with a fourth side open.

In some embodiments, the underside of article of footwear 104 may be relatively more exposed in forefoot region 110 when first chassis 102 is attached. In some embodiments, there may be a gap between the forward ends of lateral forward portion 212 and medial forward portion 210 of first chassis 102. In the embodiment shown in FIG. 22, first exposed area 214 includes a section along the forward side of article of footwear 104 disposed between this gap. In some embodiments, there may also be a section of first exposed area 214 that is forward of the gap between the two forward portions, along the forward edge of the plate. Due to this gap in some embodiments, the underside of article of footwear 104 may be fully exposed in the front end of forefoot region 110.

In different embodiments, second exposed area 248 could extend through different regions of first chassis 102. In some embodiments, for example the embodiment depicted in FIG. 22, lateral rearward portion 204 and medial rearward portion 202 may be disposed in such a way as to form second exposed area 248 in midfoot region 112 and heel region 114. In the embodiment shown in FIG. 22, lateral rearward portion 204 and medial rearward portion 202 extend from first cross-member 206 toward the rear of first chassis 102 and are bridged by second cross-member 208. In this way, second exposed area 248 may be enclosed on all sides. In one embodiment, second exposed area 248 is fully enclosed by lateral rearward portion 204, medial rearward portion 202, and second cross-member 208. In other embodiments, each of the rearward portions may not re-join another portion of first chassis 102 at the rear of first chassis 102, and second exposed area may 248 may be generally enclosed on three sides with a fourth side open. In other embodiments, second exposed area 214 may include a greater number of closed sides or a greater number of open sides. In some embodiments, the underside of article of footwear 104 may be exposed in midfoot region 112 and heel region 114 when attached to first chassis 102.

In some cases, the members and/or cross-members of first chassis 102 may be altered to adjust the size of first exposed area 214 and second exposed area 248. For example, lateral forward portion 212 may be configured as a wider shape, providing increased coverage to article of footwear 104. In other cases first cross-member 206 may not curve toward the forward end 250, so that first exposed area 214 is slightly larger. In some cases, first cross-member 206 may curve instead toward heel region 114 to further increase first exposed area 214. In other cases, first cross-member 206 may be widened, to decrease the sizes of both first exposed area 214 and second exposed area 248. Likewise, in different embodiments, each member and each cross-member may be adjusted in any manner, in order to change the size of any exposed areas.

In different embodiments the exposed areas may provide additional flexibility to article of footwear 104. For example, first exposed area 214 and second exposed area 248 may enhance the flexibility of the sole structure and other components of article of footwear 104. In some embodiments, first exposed area 214 or second exposed area 248 may permit users to increase the bending of their foot along the longitudinal midline of their sole. In one embodiment first exposed area 214 may allow users greater flexibility in the forefoot region 110, for example, to permit further or easier bending of the toes. In another embodiment, second exposed area 248 may allow users greater flexibility in the midfoot region 112. In other embodiments, one or more exposed areas may improve comfort and fit for a user.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear comprising:

an upper;

a plate attached to the upper and including a plurality of receptacles each having a first retention feature;

a plurality of cleat members operable to be selectively attached to the plate in an attached state and removed from the plate in a detached state, the plurality of cleat members including a second retention feature operable to be received by respective ones of the plurality of receptacles and engage the first retention feature of the respective receptacle to attach the cleat member to the plate in the attached state; and a chassis disposed between the plurality of cleat members and the plate and including a plurality of apertures that receive respective ones of the plurality of cleat members, a medial member extending along a medial side of the plate, a lateral member extending along a lateral side of the plate and spaced apart from the medial member, and at least one cross-member extending between and connecting the medial member and the lateral member, the lateral member and the at least one cross-member forming an H-shaped member where the plate is exposed between a medial forward portion of the medial member and a lateral forward portion of the lateral member in a forefoot region, the chassis extending continuously from the forefoot region of the plate to a heel region of the plate and being attached to the plate by the cleat members when the cleat members are in the attached state.

2. The article of footwear of claim 1, wherein the chassis is removable from the plate when the plurality of cleat members are in the detached state.

3. The article of footwear of claim 1, wherein the first retention feature is a first series of threads.

4. The article of footwear of claim 3, wherein the second retention feature is a second series of threads, the second series of threads being matingly received by the first series of threads when the cleat members are in the attached state.

5. The article of footwear of claim 1, wherein the chassis includes at least one fixed cleat member.

6. The article of footwear of claim 5, wherein the at least one fixed cleat member includes a different shape than the plurality of cleat members.

7. The article of footwear of claim 1, wherein the plate includes discrete plate segments that are spaced apart from one another along a length of the article of footwear, each of the discrete plate segments including at least one first retention feature.

8. The article of footwear of claim 7, wherein the chassis extends continuously between each of the discrete plate segments when the plurality of cleat members are in the attached state.

9. An article of footwear comprising:

an upper;

a plate attached to the upper and including a plurality of receptacles each having a first retention feature;

a plurality of cleat members operable to be selectively attached to the plate in an attached state and removed from the plate in a detached state, the plurality of cleat members including a second retention feature operable to be received by respective ones of the plurality of receptacles and engage the first retention feature of the respective receptacle to attach the cleat member to the plate in the attached state; and a chassis disposed between the plurality of cleat members and the plate and including a medial member extending along a medial side of the plate, a lateral member extending along a lateral side of the plate and spaced apart from the medial member, and at least one cross-member extending between and connecting the medial member and the lateral member, the lateral member and the at least one cross-member forming an H-shaped member where the plate is exposed between a medial rearward portion of the medial member and a lateral rearward portion of the lateral member in a forefoot region, the chassis extending continuously from the forefoot region of the plate to a heel region of the plate and being removable from the plate when the cleat members are in the detached state.

10. The article of footwear of claim 9, wherein the chassis includes a plurality of apertures that receive respective ones of the plurality of cleat members when the cleat members are in the attached state to attach the chassis to the plate.

11. The article of footwear of claim 9, wherein the first retention feature is a first series of threads.

12. The article of footwear of claim 11, wherein the second retention feature is a second series of threads, the second series of threads being matingly received by the first series of threads when the cleat members are in the attached state.

13. The article of footwear of claim 9, wherein the chassis includes at least one fixed cleat member.

14. The article of footwear of claim 13, wherein the at least one fixed cleat member includes a different shape than the plurality of cleat members.

15. The article of footwear of claim 9, wherein the plate includes discrete plate segments that are spaced apart from one another along a length of the article of footwear, each of the discrete plate segments including at least one first retention feature.

16. The article of footwear of claim 15, wherein the chassis extends continuously between each of the discrete plate segments when the plurality of cleat members are in the attached state.

* * * * *